US007116297B2

(12) United States Patent
Koga et al.

(10) Patent No.: US 7,116,297 B2
(45) Date of Patent: Oct. 3, 2006

(54) LIQUID CRYSTAL DISPLAY DEVICE AND DRIVING METHOD FOR LIQUID CRYSTAL DISPLAY DEVICE

(75) Inventors: Koichi Koga, Kanagawa (JP); Noboru Okuzono, Kanagawa (JP); Machihiko Yamaguchi, Kanagawa (JP)

(73) Assignee: NEC LCD Technologies, Ltd., (JP)

( * ) Notice: Subject to any disclaimer, the term of this patent is extended or adjusted under 35 U.S.C. 154(b) by 240 days.

(21) Appl. No.: 10/413,458

(22) Filed: Apr. 14, 2003

(65) Prior Publication Data

US 2003/0222840 A1 Dec. 4, 2003

(30) Foreign Application Priority Data

Apr. 15, 2002 (JP) ..... 2002-112713

(51) Int. Cl.
*G09G 3/36* (2006.01)

(52) U.S. Cl. ..... 345/87; 345/695

(58) Field of Classification Search ..... 345/87, 345/103, 694–696, 88
See application file for complete search history.

(56) References Cited

U.S. PATENT DOCUMENTS 4,840,460 A * 6/1989 Bernot et al. ..... 349/144
5,805,136 A * 9/1998 Silverbrook et al. ..... 345/695
5,808,594 A * 9/1998 Tsuboyama et al. ..... 345/89
6,344,841 B1 * 2/2002 Moon ..... 345/60
6,714,206 B1 * 3/2004 Martin et al. ..... 345/589
2003/0025664 A1 * 2/2003 Koga et al. ..... 345/89

FOREIGN PATENT DOCUMENTS

| | | |
|---|---|---|
| JP | 07-181451 | 7/1995 |
| JP | 2700903 | 10/1997 |
| JP | 2001-034232 | 2/2001 |
| JP | 2001-242828 | 9/2001 |

* cited by examiner

*Primary Examiner*—Bipin Shalwala
*Assistant Examiner*—Steven Holton
(74) *Attorney, Agent, or Firm*—Michael Best & Friedrich LLP

(57) ABSTRACT

In a liquid crystal display device where each unit pixel p arranged on a liquid crystal panel 101A is constituted by a plurality of pixels p1, p2, and p3, the pixels p1, p2, and p3 are divided into sub-pixels p11 and p12, sub-pixels p21, and p22, and sub-pixels p31 and p32, respectively. The liquid crystal display device is provided with driver ICs 201 and 202 for driving the sub-pixels p11, p21, and p31, and the sub-pixels p12, p22, and p32 constituting the pixels so that different gradation-brightness value characteristics may be given. Due to this, multi-gradation display can be performed.

4 Claims, 19 Drawing Sheets

| BRIGHTNESS VALUE FOR UNIT PIXEL | PIXEL p1 | PIXEL p2 | PIXEL p3 |
|---|---|---|---|
| 0 | 0 | 0 | 0 |
| 1 | 0 | 0 | 1 |
| 2 | 0 | 1 | 1 |
| 3 | 1 | 1 | 1 |
| 4 | 1 | 1 | 2 |
| 5 | 1 | 2 | 2 |
| : | : | : | : |
| : | : | : | : |
| : | : | : | : |
| 762 | 254 | 254 | 254 |
| 763 | 254 | 254 | 255 |
| 764 | 254 | 255 | 255 |
| 765 | 255 | 255 | 255 |

FIG. 19 (PRIOR ART)

LIQUID CRYSTAL DISPLAY DEVICE AND DRIVING METHOD FOR LIQUID CRYSTAL DISPLAY DEVICE

CROSS REFERENCE TO RELATED APPLICATIONS

This application claims priority based on Japanese Patent Application No. JP 2002-112713, filed Apr. 15, 2002.

BACKGROUND OF THE INVENTION

1. Field of the Invention

The present invention relates to a liquid crystal display device capable of performing multi-gradation display. Particularly, the present invention relates to a liquid crystal display device which can be driven by a driver of an existing type and yet can perform multi-gradation display with higher performance than expected with the existing type of driver.

2. Description of the Related Art

A liquid crystal display device and a plasma display device are known as image display devices using a flat panel. Usually, a digital signal is used at the input interface of these display devices. In a display device using a digital signal at its input interface, the number of displayable gradations depends on the number of bits contained in a signal to be used. As the number of gradations increases, the number of bits increases too. In case of a liquid crystal display device, a source driver achieving the largest number of gradations among source drivers now in practical use is an 8-bit type (256 gradations). Gradations more than this can not be displayed.

Suppose that a 12-bit type source driver is developed by simply increasing the number of bits. When such a 12-bit type source driver is compared with an 8-bit type source driver, the number of resistors comprised in a digital-analog converter (hereinafter referred to as DCA) for generating each gradation and the number of switch circuits for selecting the resistors required in the 12-bit type source driver are 16 ($2^{12}2/^{8}$=4096/256=16) times larger than those required in the 8-bit type source driver. Consequently, the size of the circuit becomes considerably large, and an increase in costs is inevitable because of expansion of the chip size. Hence, there occurs an idea of enabling display of a larger number of gradations than achieved by an existing circuit system yet with the use of an existing circuit system. As one method therefore a method of using each unit pixel by dividing it into a plurality of pixels has been proposed.

Unexamined Japanese Patent Application KOKAI Publication No. 2001-34232 proposes one such method. FIG. 16 is a block diagram showing an example of the structure of a liquid crystal display device according to a prior art, to which the present invention will be applied. As shown in FIG. 16, the liquid crystal display device 100 comprises a color liquid crystal panel 101, a backlight 102, a cell driver 103, a data processing unit 104, and an input/output (I/F) unit 105.

The color liquid crystal panel 101 displays a color image by liquid crystal cells arranged on a plane. The backlight 102 is a light source which emits white-color light from the back of the liquid crystal panel, so that the liquid crystal panel may perform color image display by transmissive light. The cell driver 103 generates a drive signal for driving each liquid crystal cell of the liquid crystal panel based on input data. The data processing unit 104 performs data processing for supplying input data to the cell driver 103 in response to an input digital signal. The I/F unit 105 constitutes an interface for external inputting and outputting. The cell driver 103 is built up by a source driver (not shown) and a gate driver (not shown). The source driver controls the source of each transistor for driving each liquid crystal cell along the arrangement in the vertical direction (column direction). The gate driver controls the gate of each transistor along the arrangement in the horizontal direction (row direction).

FIG. 17 are diagrams for explaining an example of a display screen of a conventional liquid crystal display device, which is disclosed in the aforementioned Unexamined Japanese Patent Application KOKAI Publication No. 2001-34232. FIG. 17(A) is a view of the color liquid crystal panel in partial enlargement. FIG. 17(B) is a diagram showing an example of how to divide each unit pixel. As shown in FIG. 17(A), in case of using color filters, the display screen of the color liquid crystal panel 101 of the conventional liquid crystal display device is structured in a way that an R (red) pixel, a G (green) pixel, and a B (blue) pixel are sequentially and repeatedly arranged horizontally in each row. With the use of the color filters, color display is performed through these R pixels, G pixels, and B pixels based on red image data, green image data, and blue image data respectively. However, a monochrome image is displayed in each liquid crystal cell constituting each pixel of the color liquid crystal panel 101.

Specifically, in the color liquid crystal panel 101, one set of an R pixel, a G pixel, and a B pixel is used as a unit pixel and monochrome display is performed in each unit pixel. Since a unit pixel of a color image is constituted by an R pixel, a G pixel, and a B pixel in case of using color filters, the number of brightness levels displayable by one unit pixel is three times as large as the number of brightness levels displayable by each of the R pixel, the G pixel, and the B pixel.

Therefore, it is possible to break the gradation levels of a display image into more minutely-stepped levels by dividing the brightness level range into, for example, three and scale-marking each divided range. Let it be assumed that one unit pixel p is divided into three pixels p1, p2, and p3 as shown in FIG. 17(B), and each of the pixels p1, p2, and p3 performs 8-bit display. Since the brightness level range displayable by each pixel is from 0 to 255, the brightness level range displayable by the unit pixel p is from 0 to 765 (255×3). A display image including a high gradation level can be achieved by arranging that the smallest value 0 in the brightness level range correspond to the smallest value in image data and the largest value 765 in the brightness level range correspond to the largest value in the image data.

When the data processing unit 104 supplies a brightness value converted from image data to the unit pixel p, it divides the value almost equally among the three pixels p1, p2, and p3. Specifically, let a case be considered where 8-bit image data is input to a color display for performing 8-bit display. The 8-bit image data is composed of values of 0 to 255. In this case, it is arranged that the smallest value in the image data correspond to the smallest brightness value 0 of the color display and the largest value in the image data correspond to the largest brightness value 765 of the color display.

FIG. 18 shows a relationship between brightness values of a unit pixel and brightness values of each pixel in a conventional liquid crystal display device. The data processing unit 104 divides a brightness value acquired from image data among the pixels p1, p2, and p3 as shown in FIG. 18. For example, in case of a brightness value 0 for the unit pixel p, the pixels p1, p2, and p3 are given shares of 0, 0, and 0 respectively. In case of a brightness value 1 for the unit pixel p, the pixels p1, p2, and p3 are given shares of 0, 0, and 1 respectively. In case of a brightness value 2 for the unit pixel p, the pixels p1, p2, and p3 are given shares of 0, 1, and 1 respectively. Likewise, until the brightness value 765 for the unit pixel p, the brightness value for each pixel is determined in the same way. To sum up, according to the conventional liquid crystal display device 100 shown in FIG. 17, a brightness value is equal to the gradation level input to the liquid crystal display device 100. According to the prior art, in the liquid crystal display device 100, the unit pixel p is divided into three homogeneous pixels p1, p2, and p3, thereby achieving an almost three-times-larger number of gradations by adding the gradations (input data to the driver) of all the three pixels. FIG. 19 shows a relationship between input gradation levels and brightness values in the conventional liquid crystal display device 100. FIG. 19 reveals that the relationship between gradation levels input to the liquid crystal display device 100 (or data for each pixel input to the driver) and brightness values (standardized brightness values in FIG. 18) is linear. Therefore, the sum of brightness values of all the pixels p1, p2, and p3 is equal to the brightness value of the unit pixel p.

Further, the Publication of Japanese Patent No. 2700903 discloses a technique for regarding a plurality of neighboring pixels as one display unit, controlling the gradation level of each display unit by changing combinations of the lighting and non-lighting states of each pixel in the display unit or the gradation level of each pixel in the display unit, and arranging that the center of the display unit correspond to the center of the densities of the middle tones.

The invention disclosed in the Publication of Japanese Patent No. 2700903 is directed to a liquid crystal display device of a so-called simple matrix type, and for performing gradational display by varying the width of a data electrode.

SUMMARY OF THE INVENTION

A liquid crystal display device including a driving method and/or driving device is presented. The conventional liquid crystal display device 100 shown in FIGS. 17 to 19, the input gradation level of each of the pixels p1, p2, and p3 is fixed linearly with respect to the brightness value of each of the pixels p1, p2, and p3. Therefore, the number of gradations displayable by a unit pixel can be expanded to only three times as large as the number of gradations displayable by each pixel at the most. Accordingly, for example, in a case where the number of gradations displayable by each pixel is 256, the number of gradations displayable by a unit pixel is only 765. Therefore, it has been impossible to perform a higher-level multi-gradation display, with the use of a conventional liquid crystal display device.

Meanwhile, a frame rate control (hereinafter referred to as FRC) method has been known as a method for performing multi-gradation display. The FRC method is for forming, for example, four 8-bit image data by dividing 10-bit image data, and performing 10-bit gradational display with the use of 8-bit image data by sequentially displaying the four image data while increasing the frame frequency.

Multi-gradation display can be easily performed by the FRC method. However, since image display by the FRC method utilizes the afterimage effect caused by the human visual function, there is a problem that flickers occur many times. To get rid of flickers, it is necessary to increase the frame frequency and switch displays at a high speed. However, since there is a limit on the response speed of the driver IC of a liquid crystal display device or a liquid crystal display device itself, display switching at a high speed has been difficult. The present invention was made in view of the above circumstance, and an object of the present invention is to provide a liquid crystal display device which can perform multi-gradation display of a desired level without performing the FRC.

To achieve the above object, a liquid crystal display device according to the present invention is a liquid crystal display device having:

- a liquid crystal panel having substrates sandwiching a liquid crystal layer therebetween;
- a plurality of unit pixels disposed on the one of the substrates;
- a plurality of pixels formed in the unit pixels;
- a plurality of sub-pixels formed in the unit pixels; and
- a driving device which drives the sub-pixels so that the sub-pixels have different gradation-brightness value characteristics from each other.

The sub-pixels may have different areas from each other; and

- the driving device applies a gradation-brightness value characteristic of a wider brightness value range to the sub-pixels having a larger area than others.

The driving device may apply a gradation-brightness value characteristic of a narrower brightness value range to the sub-pixels having a smaller area than the larger area, and the gradation-brightness value characteristic of the narrower brightness value range complementing each one gradation of the gradation-brightness value characteristic of the wider brightness value range.

The gradation-brightness value characteristic of the wider brightness value range may be determined by upper bits of a gradation voltage setting input which is input to the driving device, and the gradation-brightness value characteristic of the narrower brightness value range may be determined by lower bits of the gradation voltage setting input.

The sub-pixels may have almost equal areas to each other;

- the driving device may give one of the sub-pixels a dynamic range corresponding to an upper half of a voltage-brightness value characteristic based on a driving input, and
- the driving device may give another one of the sub-pixels a dynamic range corresponding to a lower half of the voltage-brightness value characteristic based on the driving input.

The voltage-brightness value characteristic corresponding to the upper half and the voltage-brightness value characteristic corresponding to the lower half may be determined by gradation voltage setting inputs having a same number of bits.

The gradation voltage setting inputs may be obtained by applying a frame rate control to original gradation voltage setting inputs.

The driving device may include a plurality of drivers which generate an output for driving sub-pixels in a substantially same positional relation with respect to pixels to which these sub-pixels belong respectively, so that these sub-pixels have a substantially same gradation-brightness value characteristic.

The driving device may include a single driver generating a plurality of outputs sub-pixels in a substantially same positional relation, so that the sub-pixels have a substantially same gradation-brightness value characteristic.

The liquid crystal display panel may be for displaying a color image.

A liquid crystal display device according to a second aspect of the present invention is a liquid crystal display device having:

a pair of substrates;

a liquid crystal layer disposed between the pair of substrates;

a plurality of gate lines disposed on one of the pair of substrates;

a plurality of drain lines disposed on one of the pair of substrates and overlapped with the plurality of gate lines;

unit pixels formed in a matrix shape of the plurality of gate lines and the plurality of drain lines;

wherein the unit pixels having a plurality of pixels, and the plurality of pixels further having a plurality of sub-pixels;

a driving device applying a voltage to the plurality of sub-pixels;

wherein the driving device including a plurality of drivers which generate outputs for the sub-pixels connected to a same gate line but to different drain lines which are adjacent; and the sub-pixels having different gradation-brightness value characteristics from each other.

The sub-pixels may have different areas from each other; and the driving device applies a gradation-brightness value characteristic of a wider brightness value range to the sub-pixels having a larger area than others.

The driving device may apply a gradation-brightness value characteristic of a narrower brightness value range to the sub-pixels having a smaller area than the larger area, and the gradation-brightness value characteristic of the narrower brightness value range complementing each one gradation of the gradation-brightness value characteristic of the wider brightness value range.

The gradation-brightness value characteristic of the wider brightness value range may be determined by upper bits of a gradation voltage setting input which is input to the driving device; and the gradation-brightness value characteristic of the narrower brightness value range may be determined by lower bits of the gradation voltage setting input.

The sub-pixels may have almost equal areas to each other;

the driving device may give one of the sub-pixels a dynamic range corresponding to an upper half of a voltage-brightness value characteristic based on a driving input, and the driving device may give another one of the sub-pixels a dynamic range corresponding to a lower half of the voltage-brightness value characteristic based on the driving input.

The voltage-brightness value characteristic corresponding to the upper half and the voltage-brightness value characteristic corresponding to the lower half may be determined by gradation voltage setting inputs having a same number of bits.

A method according to a third aspect of the present invention is a method of driving a liquid crystal display device where a plurality of pixels constituting each unit pixel and each of the plurality of pixels divided into a first and a second sub-pixels, the method having:

a step of supplying a first driver with a voltage changeable within a range of a predetermined voltage V2 to a predetermined voltage V1, as an input value of a gradation voltage for driving the first sub-pixel;

a step of supplying a second driver with a voltage changeable within a range of a predetermined voltage V3 and the predetermined voltage V1, as an input value of a gradation voltage for driving the second sub-pixel, and a relationship among the voltages V3, V2, and V1 represented by V2>V3>V1.

The predetermined voltage V2 may be a maximum value of a drive voltage to be applied to the first sub-pixel, and the predetermined voltage V1 may be a minimum value of a drive voltage to be applied to the first sub-pixel.

The predetermined voltage V3 may be a maximum value of a drive voltage to be applied to the second sub-pixel.

The plurality of pixels may be for displaying a color image.

BRIEF DESCRIPTION OF THE DRAWINGS

These objects and other objects and advantages of the present invention will become more apparent upon reading of the following detailed description and the accompanying drawings in which:

FIG. 19 is a diagram showing a relationship between input gradation levels and brightness values, according to the conventional liquid crystal panel.

DETAILED DESCRIPTION OF THE PREFERRED EMBODIMENTS

The embodiments of the present invention will now be explained with reference to the drawings. The explanation will be made in detail by employing each embodiment.

First Embodiment

Figure 1:
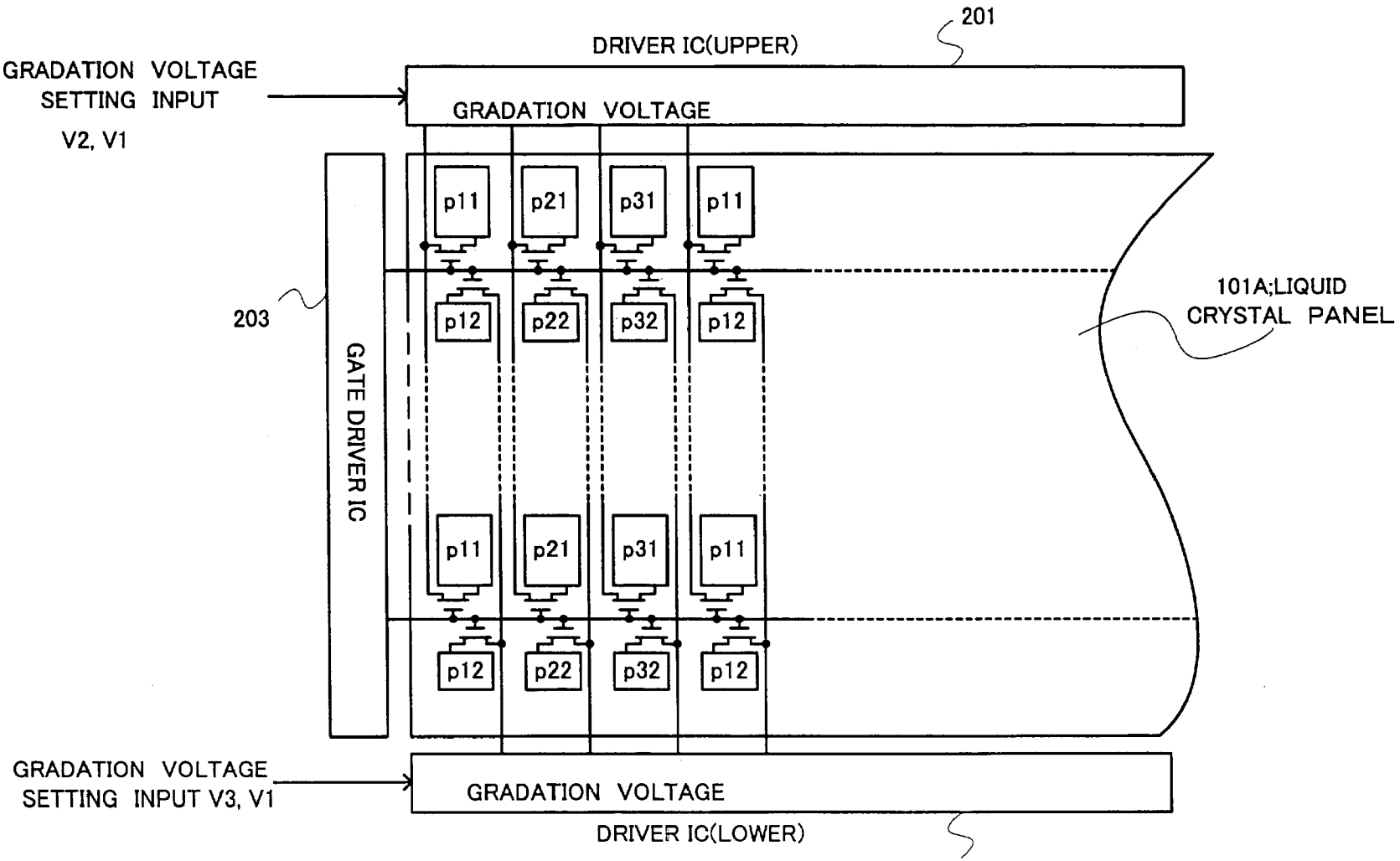
FIG. 1 is a circuit diagram showing a basic structure of a liquid crystal panel according to a first embodiment of the present invention.
Figure 2:
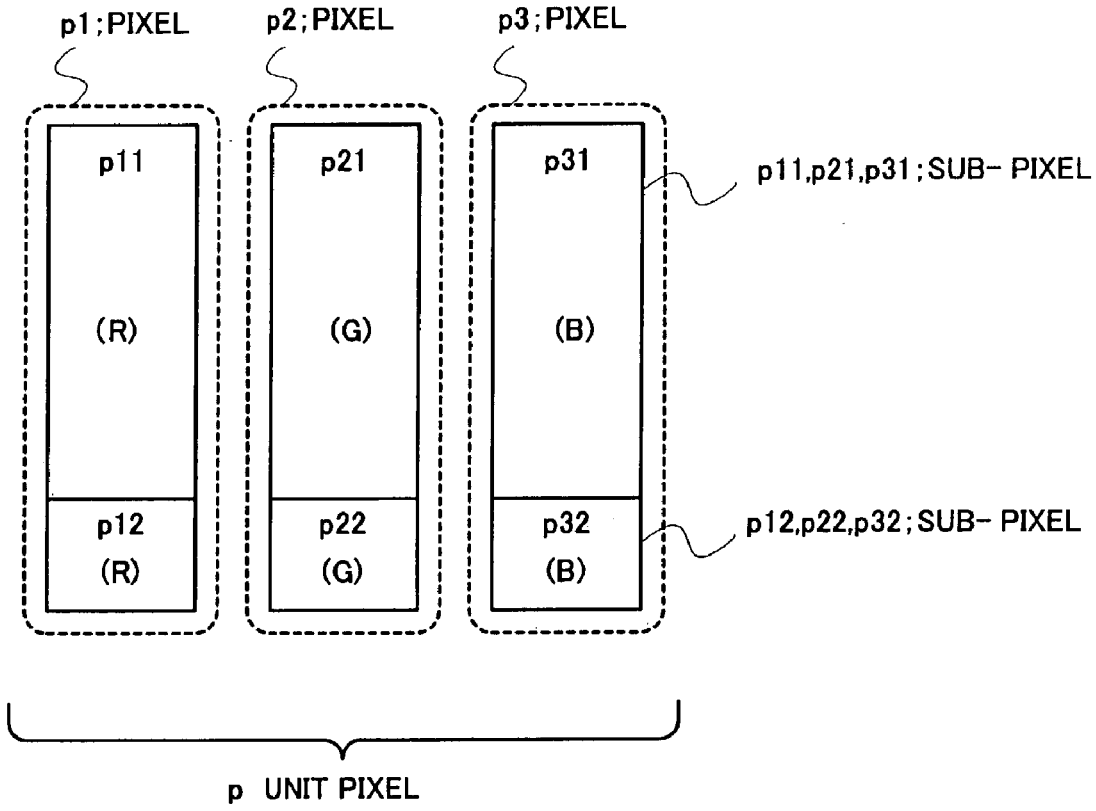
FIG. 2 is a diagram showing a structure of a unit pixel in the liquid crystal panel according to the first embodiment.

FIG. 1 is a circuit diagram showing the basic structure of a liquid crystal panel according to the first embodiment of the present invention. FIG. 2 is a diagram showing the structure of a unit pixel included in the liquid crystal panel according to the present embodiment. FIG. 3 are diagrams showing relationships between gradations and standardized brightness values according to the liquid crystal panel of the present embodiment. FIG. 4 is a diagram showing a relationship between gradation voltages and relative brightness values according to the liquid crystal panel of the present embodiment.

FIG. 1 shows the schematic structures of a liquid crystal panel 101A, source driver ICs (hereinafter the source driver IC will be simply referred to as driver ICs) 201 and 202, and a gate driver IC 203. As shown in FIG. 1, as driver ICs for switching on/off pixel columns in a vertical direction with respect to the liquid crystal panel 101A, the first driver IC (upper) 201 is arranged on the upper side of the liquid crystal panel 101A and the second driver IC (lower) 202 is arranged on the lower side thereof. In addition, the gate driver IC 203 for scanning pixel rows is arranged horizontally with respect to the liquid crystal panel 101A.

In the liquid crystal panel 101A, a plurality of great-groups of sub-pixels each of which is made up of a first group including sub-pixels p11, p21, and p31 and a second group including sub-pixels p12, p22, and p32 are repeatedly arranged horizontally along each output from the gate driver IC 203. Outputs from the first driver IC 201 are connected to the data electrodes of TFTs (Thin Film Transistors) for switching on/off the sub-pixels p11, p21, and p31 of the first group respectively. Outputs from the second driver IC 202 are connected to the data electrodes of TFTs for switching on/off the sub-pixels p12, p22, and p32 of the second group respectively.

FIG. 2 explains the structure of each sub-pixel shown in FIG. 1 more specifically. As shown in FIG. 2, the sub-pixels p11 and p12 together form a pixel p1. The sub-pixel p21 and p22 together form a pixel p2. The sub-pixels p31 and p32 together form a pixel p3. Further, the pixels p1, p2, and p3 form a unit pixel p. And as shown in FIG. 1, the gate electrodes of the TFTs for switching on/off the pixels p1, p2, and p3 are commonly connected to one output from the gate driver IC 203 for controlling scanning of the liquid crystal panel 101A.

The upper driver IC 201 is supplied with a voltage changeable within a range of V2 to V1, as a gradation voltage setting input for driving the pixels. The value V2 is the maximum value of the drive voltage (driver IC output voltage) to be applied to the sub-pixels p11, p21, and p31. The value V1 is the minimum value of the drive voltage to be applied to the sub-pixels p11, p21, and p31. Accordingly, the dynamic range of voltages to be applied by the upper driver IC 201 varies from V2 to V1.

The lower driver IC 202 is supplied with a voltage changeable within a range of V3 to V1, as a gradation voltage setting input for driving the pixels. The value V3 is the maximum value of the drive voltage to be applied to the sub-pixels p12, p22, and p32. The value V1 is equal to the gradation voltage setting input V1 of the upper driver IC 201. Accordingly, the dynamic range of the voltages to be applied by the lower driver IC 202 varies from V3 to V1. The relationship among the voltages V3, V2, and V1 is represented by V2>V3>V1.

Next, the operation of the liquid crystal panel 101A according to the present embodiment will be explained with reference to FIG. 1 to FIG. 3 shows the relationships between gradation voltages to be applied to the liquid crystal cells by the driver ICs and brightness values of the liquid crystal panel 101A, with regard to a case where existing 8-bit digital drivers are used as the driver ICs. In the case of using the 8-bit digital drivers, 256 gradations can be displayed if the voltage output from the upper driver IC 201 is allowed to vary within the range of gradation voltage setting inputs V2 to V1. Likewise, 256 gradations can be displayed if the voltage output from the lower driver IC 202 is allowed to vary within the range of gradation voltage setting inputs V3 to V1.

As shown in FIG. 2, areas allotted to the sub-pixels are different between the first group (hereinafter referred to as p*1) including p11, p21, and p31, and the second group (hereinafter referred to as p*2) including p12, p22, and p32. In a case where the top 8 bits of 16-bit digital image data are input to the upper driver IC 201 and the bottom 8 bits are input to the lower driver IC 202, it is arranged that a ratio of standardized brightness values between the group of sub-pixels p*1 and the group of sub-pixels p*2 be 256:1.

Figure 3A:
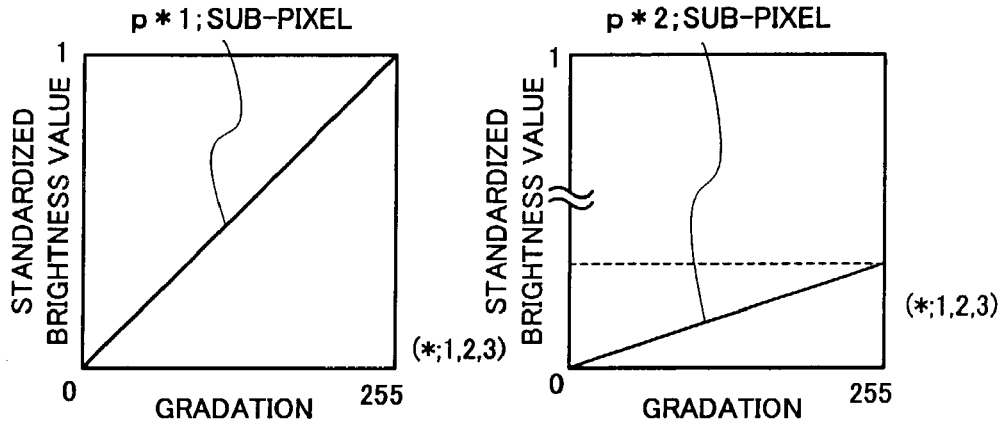
FIGS. 3A and 3B are diagrams showing relationships between gradations and standardized brightness values according to the liquid crystal panel of the first embodiment.
Figure 4:
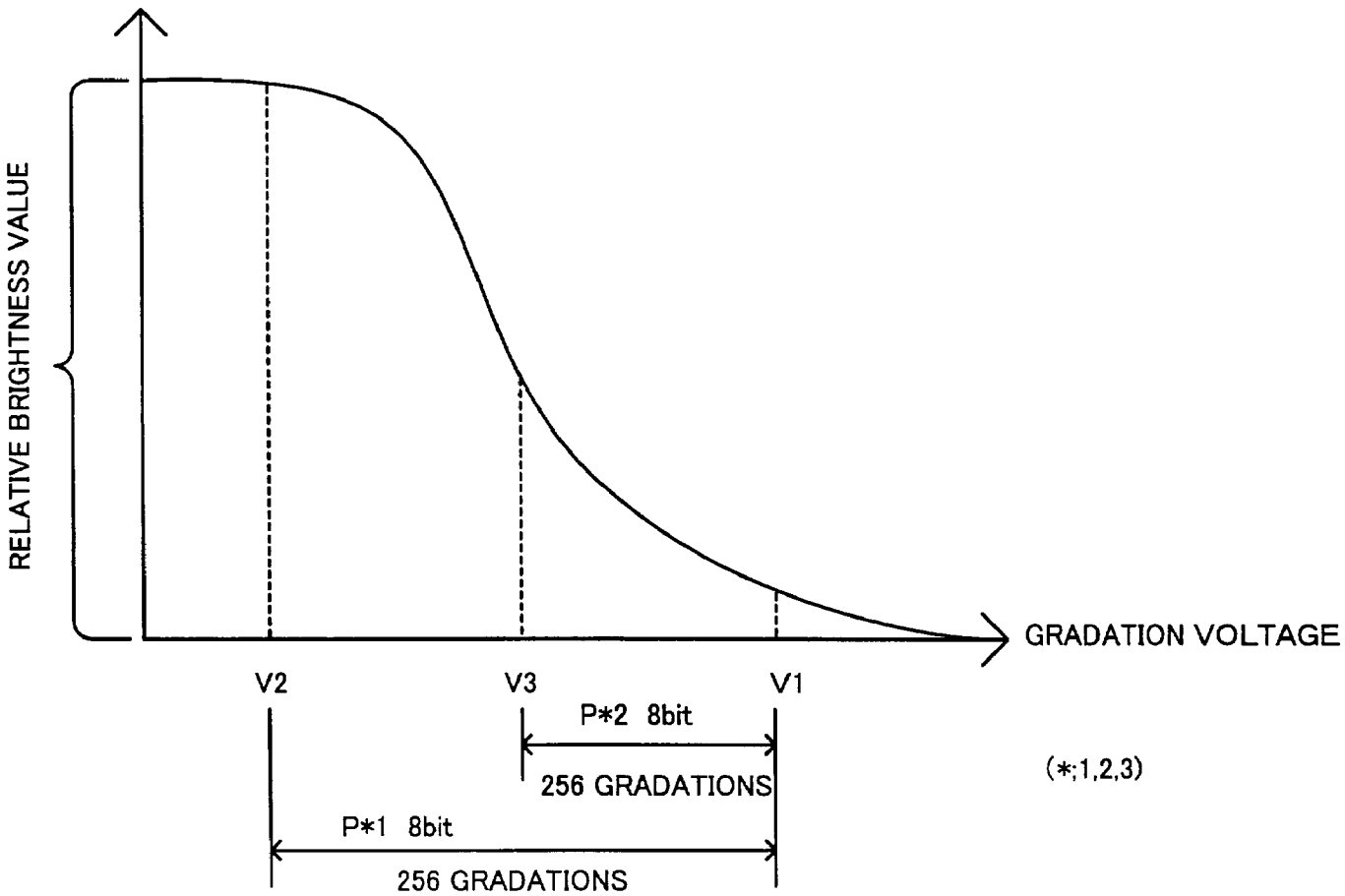
FIG. 4 is a diagram showing a relationship between gradation voltages and relative brightness values according to the liquid crystal panel of the first embodiment.

FIG. 3A shows relationships between gradations and standardized brightness values, with regard to the group of sub-pixels p*1 and the group of sub-pixels p*2 respectively. With respect to the sub-pixels p11 and p12, if the maximum standardized brightness value of the sub-pixel p11 is assumed to be 1, the maximum standardized brightness value of the sub-pixel p12 should be 1/256. In this case, the upper driver IC 201 supplies the sub-pixel p11 with a voltage having a 256th gradation characteristic which is generated by a ladder resistor (not shown) arranged inside the upper driver IC 201 based on the voltage amplitude range defined by the dynamic range of V2 to V1, as the drive voltage. The lower driver IC 202 supplies the sub-pixel p12 with a voltage having a 256th gradation characteristic which is generated by a ladder resistor (not shown) arranged inside the lower driver IC 202 based on the voltage amplitude range defined by the dynamic range of V3 to V1, as the drive voltage.

As shown in FIG. 4, the gradation voltage setting input V2 is the maximum value of a voltage to be applied to a liquid crystal cell, among gradation-brightness value characteristics of the liquid crystal panel 101A, while the gradation voltage setting input V1 is the minimum value. The value V3 causes a voltage which generates a relative brightness corresponding to the weight of the bottom 8 bits included in the 16-bit digital data.

Figure 3B:
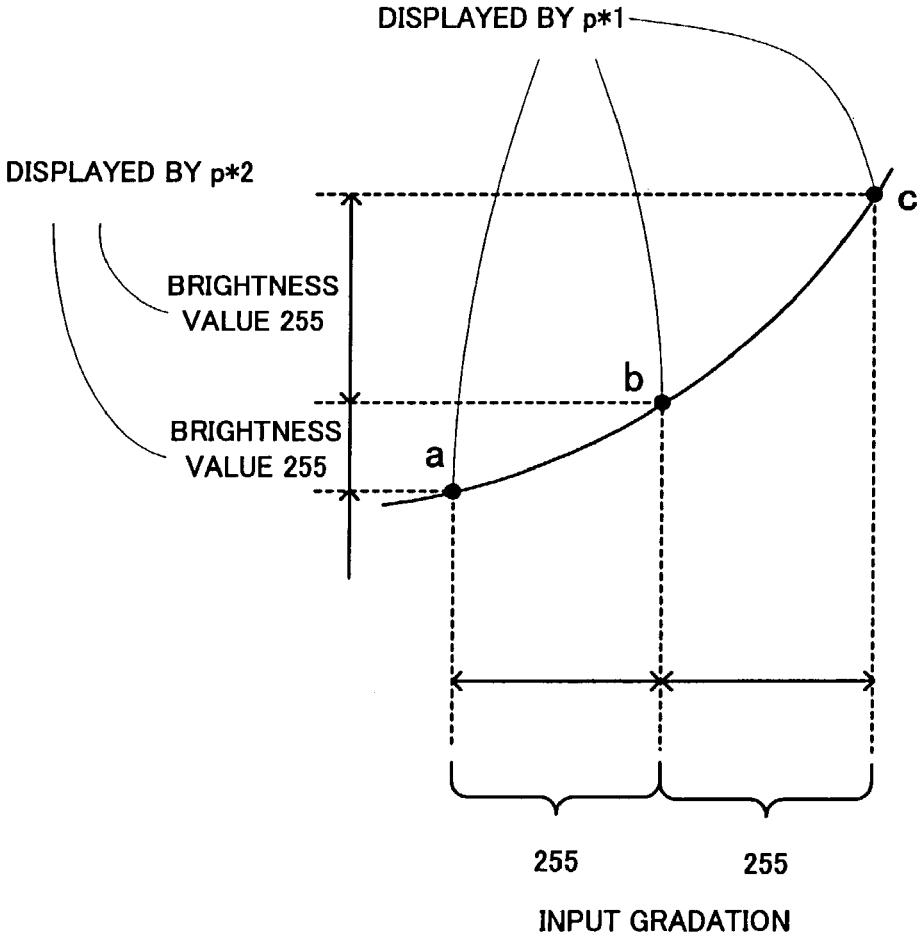

FIG. 3B shows the graph representing gradation-brightness value characteristics of the liquid crystal panel 101A in partial enlargement. The interval between the points a and b, and the interval between the points b and c respectively represent one gradation of the sub-pixel p11, p21, or p31. One gradation of the sub-pixel p12, p22, or p32 is represented by 1/256 of this interval. The area ratio between the group of sub-pixels p*1 and the group of sub-pixels p*2 is set at 256:1, likewise the ratio of standardized brightness values. The group of sub-pixels p*1 displays a brightness level corresponding to an upper gradation, and the group of sub-pixels p*2 displays a brightness level corresponding to a lower gradation. The brightness level displayed by each of the pixel p1, p2, and p3 is the total of the brightness levels displayed by the groups of sub-pixels constituting each pixel.

Accordingly, in case of processing 16-bit digital data, if the top 8 bits are input to the upper driver IC 201 which drives the group of sub-pixels p*1 and the bottom 8 bits are input to the lower driver IC 202 which drives the group of sub-pixels p*2, the number of gradations displayable by each of the pixels p1, p2, and p3 is 65536 (256×256). Therefore, a color liquid crystal panel, in which R, G, and B color filters are formed over the pixels p1, p2, and p3 respectively, can display 65536×3 colors. A monochrome liquid crystal panel, which includes no color filter, can display 65536×3 gradations.

As described above, in the liquid crystal panel according to the present embodiment, the pixels p1, p2, and p3 are divided into sub-pixels p11, p21, and p31, and sub-pixels p12, p22, and p32 respectively, and the sub-pixels confronting each other are divided at a division ratio (area ratio) other than 1 and driven by different driver ICs from each other. Due to this, it is possible to perform multi-gradation display which is greater than multi-gradation display acquired by a conventional liquid crystal panel, without using a complicated circuit structure, but using existing driver ICs.

According to the first embodiment, a value other than 1 is used as the division ratio for the sub-pixels. However, the division ratio for the sub-pixels may be 1 (i.e., two sub-pixels occupy regions having the same area as each other). The following will explain an embodiment regarding this case.

Second Embodiment

Figure 5:
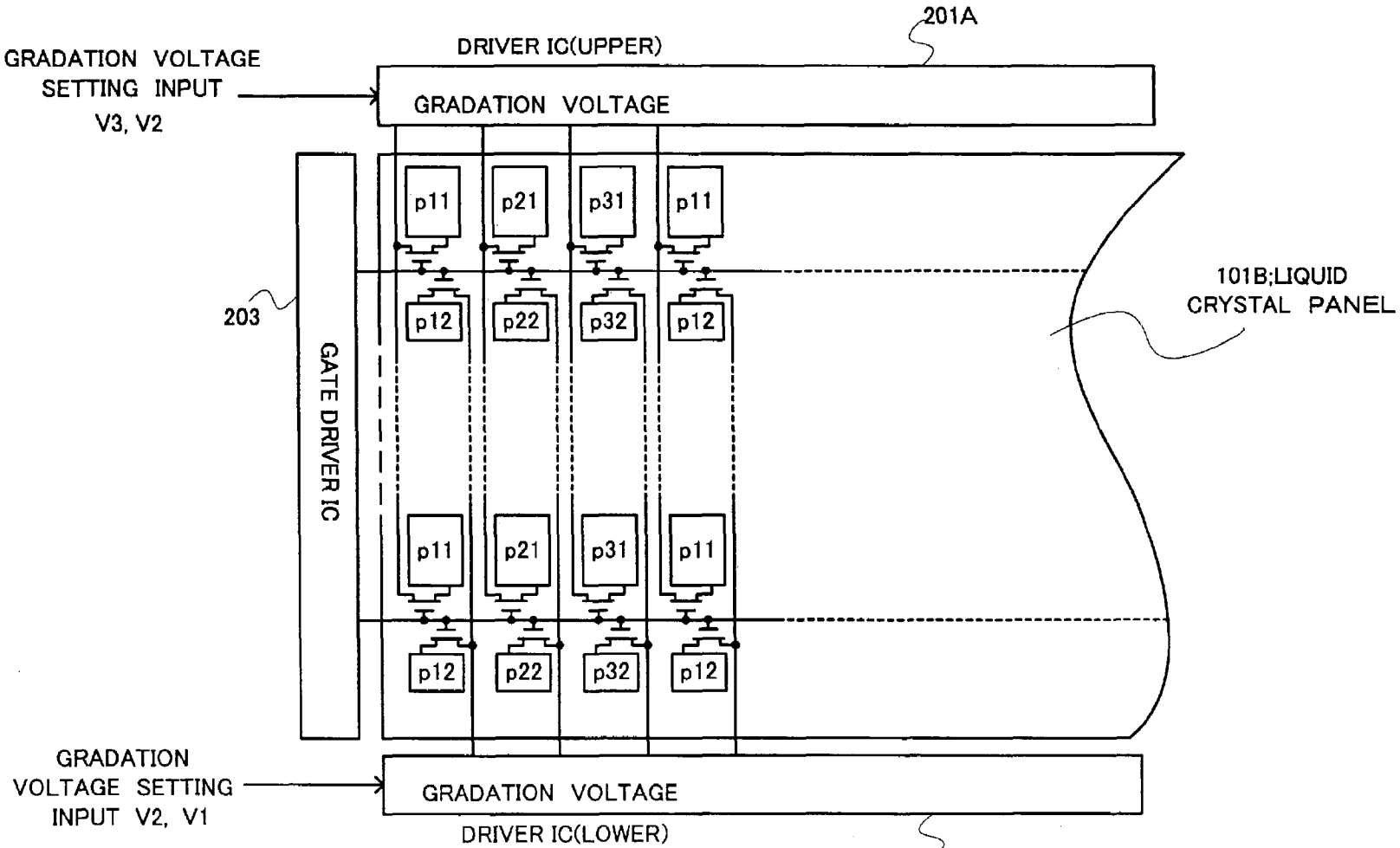
FIG. 5 is a circuit diagram showing a basic structure of a liquid crystal panel according to a second embodiment of the present invention.
Figure 6:
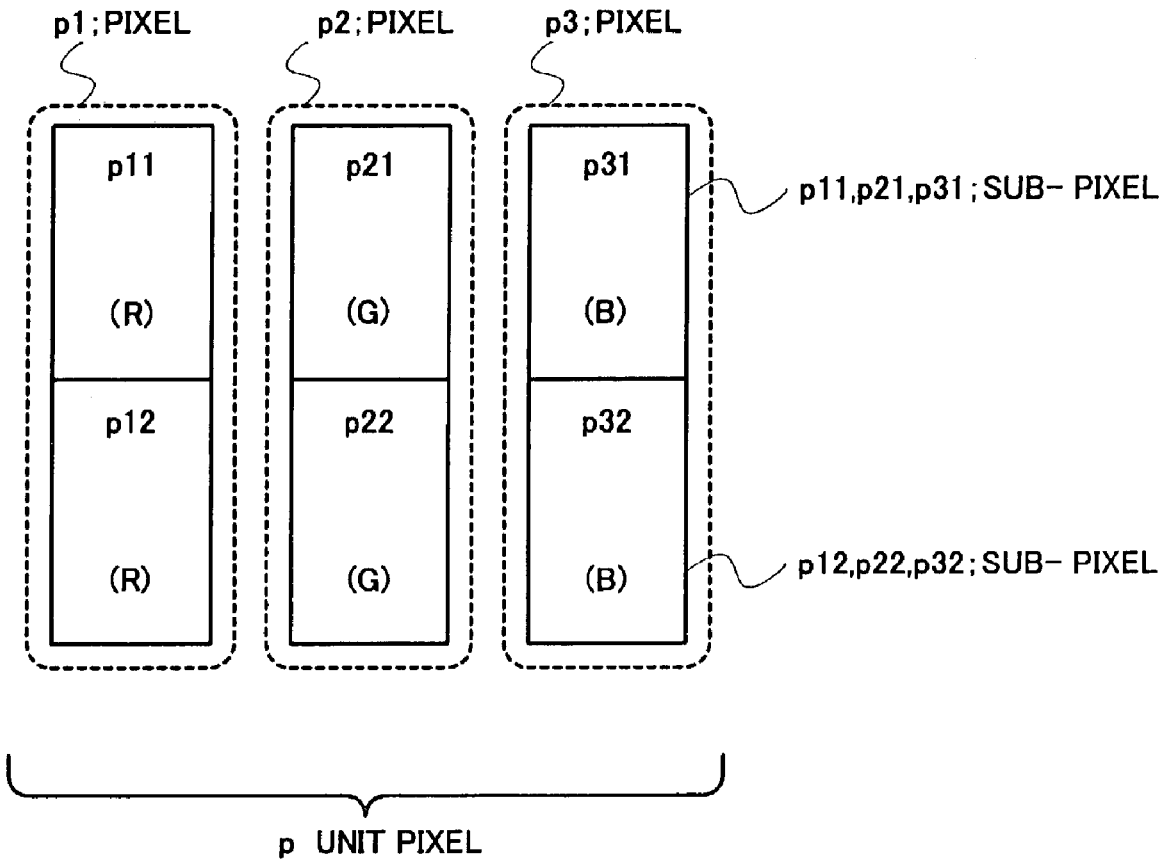
FIG. 6 is a diagram showing a structure of a unit pixel in the liquid crystal panel according to the second embodiment.

FIG. 5 is a circuit diagram showing a basic structure of a liquid crystal panel according to the second embodiment of the present invention. FIG. 6 is a diagram showing a structure of a unit pixel included in the liquid crystal panel according to the present embodiment. FIG. 7 are diagrams showing relationships between gradation voltages and relative brightness values according to the liquid crystal panel of the present embodiment. FIG. 8 are diagrams showing relationships between gradations and standardized brightness values according to the liquid crystal panel of the present embodiment.

FIG. 5 shows the schematic structures of a liquid crystal panel 101B, driver ICs 201A and 202A, and a gate driver IC 203 according to the present embodiment. The liquid crystal panel 101B according to this embodiment has an area ratio between sub-pixels which is different from that of the liquid crystal panel 101A according to the first embodiment. The structures of the first driver IC 201A and the second driver IC 202A which are arranged on the upper side and the lower side of the liquid crystal panel 101B respectively, and the structure of the gate driver IC 203 for scanning pixel rows in the horizontal direction are same as those of the driver ICs 201 and 202 and the gate driver IC 203 according to the first embodiment shown in FIG. 1. However, voltages generated by the driver ICs 201A and 202A are different from those in the first embodiment, correspondingly to that the area ratio between sub-pixels is different from that of the first embodiment.

FIG. 6 explains the structure of each sub-pixel shown in FIG. 5 more specifically. The hierarchical structures between the R sub-pixels p11 and p12 and the pixel p1, between the G sub-pixels p21 and p22 and the pixel p2, and between the B sub-pixels p31 and p32 and the pixel p3, and the hierarchical structure between the pixels p1, p2 and p3, and the unit pixel p are the same as those according to the first embodiment shown in FIG. 2. However, as shown in FIG. 6, the difference between the present embodiment and the first embodiment is that the areas of the sub-pixels are equal between the group p*1 and the group p*2, i.e., the area ratio is 1, according to the present embodiment.

Figure 7A:
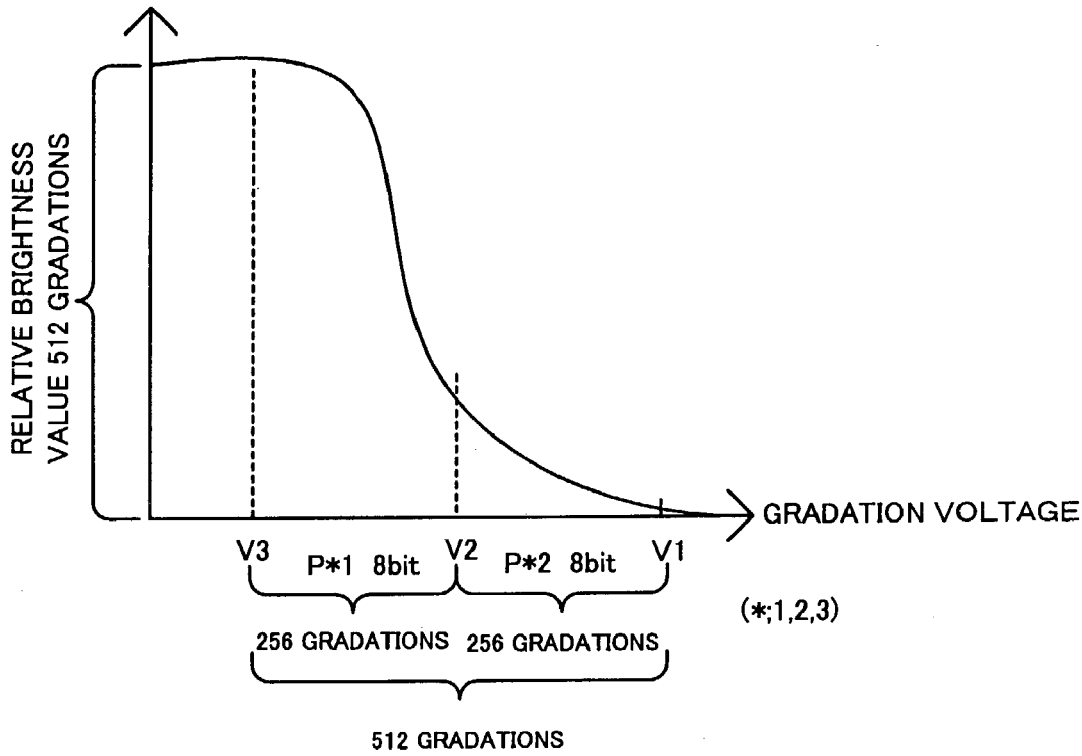
FIGS. 7A and 7B are diagrams showing relationships between gradation voltages and relative brightness values according to the liquid crystal panel of the second embodiment.

FIG. 7A shows relative brightness characteristics of a unit pixel with respect to gradation voltage setting inputs to driver ICs, in a case where the gradation resolution of each output from the driver ICs is 8 bits (256 gradations). 8-bit digital data containing gradation information is input to each driver IC. Each driver IC retains 256 voltage values which correspond to 256 gradations respectively and which are obtained by dividing a voltage range defined by a gradation voltage setting input by 256. Each driver IC selects a voltage value corresponding to the gradation indicated by the input digital data, and outputs the selected voltage value to the data electrode. Generally, the 256 voltage values retained in each driver IC are set to coincide with the voltage-brightness value characteristics of the liquid crystal, by adjusting the resistance value of a ladder resistor (not shown) included inside each driver IC.

The driver IC 201A which is connected to the upper side of the liquid crystal panel 101B for driving the group of sub-pixels p*1 is supplied with gradation voltage setting inputs within a range of V3 to V2. Therefore, the dynamic range of the voltages to be applied to each pixel is V3 to V2. The driver IC 202A which is connected to the lower side of the liquid crystal panel 101B for driving the group of sub-pixels p*2 is supplied with gradation voltage setting inputs within a range of V2 to V1. Therefore, the dynamic range of the voltages to be applied to each pixel is V2 to V1. Since the upper sub-pixels and lower sub-pixels constituting the pixels p1, p2, and p3 are equal-sized, the value V2 should be such a voltage value as would generate the lowest brightness level for the group of sub-pixels p*1 and at the same time would generate the highest brightness level for the group of sub-pixels p*2.

FIG. 8 show relationships between gradation voltages (data input by the driver) indicative of 0 to 255 gradations for each pixel and standardized brightness values. In a case where the maximum value of the standardized brightness values of the whole unit pixel p is defined as 3, the maximum standardized brightness values for the pixels p1, p2, and p3 are 1 respectively, which is ⅓ of the maximum value 3 of the unit pixel p. Further, the ranges of gradation voltages to be applied are different between the group of sub-pixels p*1 and the group of sub-pixels p*2. Therefore, the ranges of standardized brightness values for the sub-pixels constituting the pixels are different between the group of sub-pixel p*1 and the group of sub-pixels p*2, namely, the range of 0.5 to 1 and the range of 0 to 0.5 respectively. Accordingly, the brightness value of each of the pixels p1, p2, and p3 is the sum of the brightness values of the sub-pixels constituting each pixel (p*1+p*2).

Figure 8A:
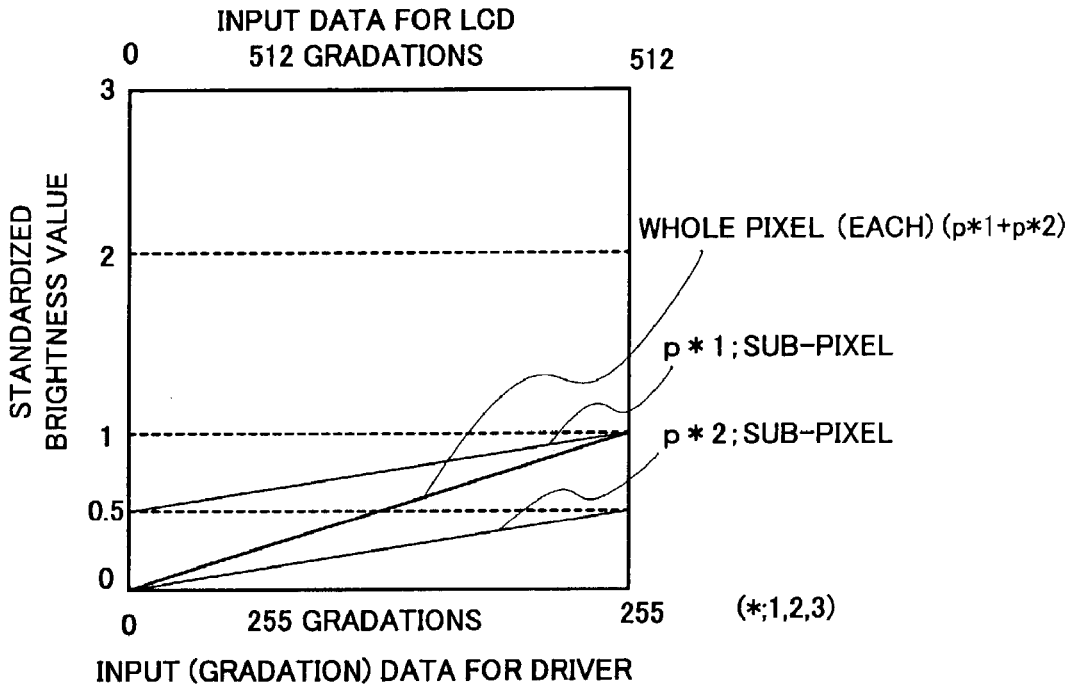
FIGS. 8A and 8B are diagrams showing relationships between gradations and standardized brightness values according to the liquid crystal panel of the second embodiment.
Figure 8B:
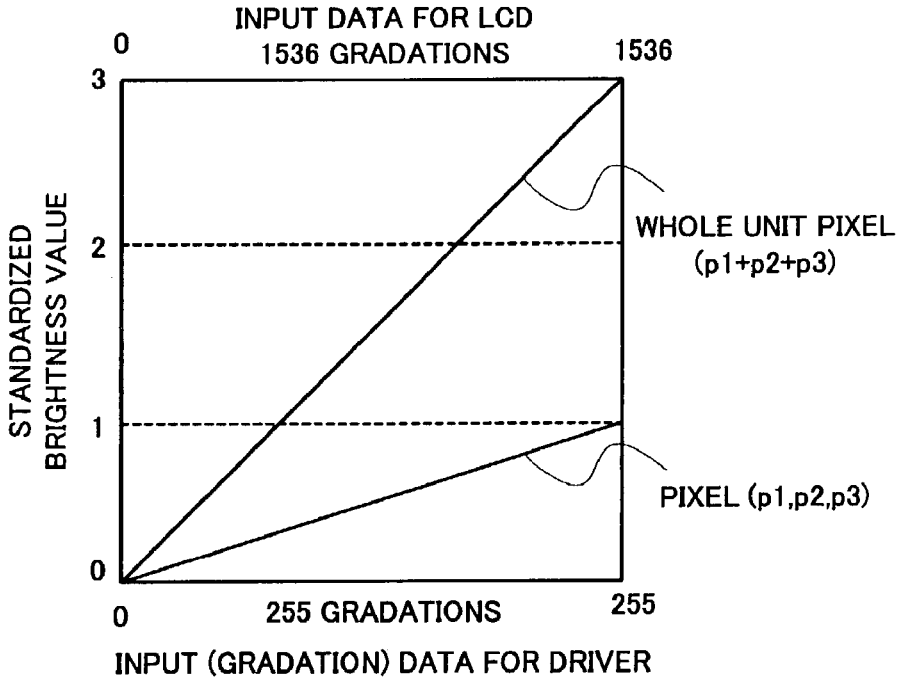

Further, the brightness value of each unit pixel is represented by the total of the brightness values of the pixels constituting each unit pixel. Therefore, in a case where the largest brightness value of each of the pixels p1, p2, and p3 is 1, the largest brightness value of the unit pixel is the treble, i.e., 3. To represent this relationship by numbers of gradations, in case of a color liquid crystal panel in which R, G, and B color filters are formed over the pixels, the number of gradations displayable by each sub-pixel is 256, the number of gradations displayable by each pixel is the double (512), and 512×3 colors can be displayed by each unit pixel, as shown in FIG. 8A. In case of a monochrome liquid crystal panel which does not include a color filter, 512 gradations can be displayed by each pixel and thus 1536 gradations (512×3) can be displayed by each unit pixel, as shown in FIG. 8B.

Figure 7B:
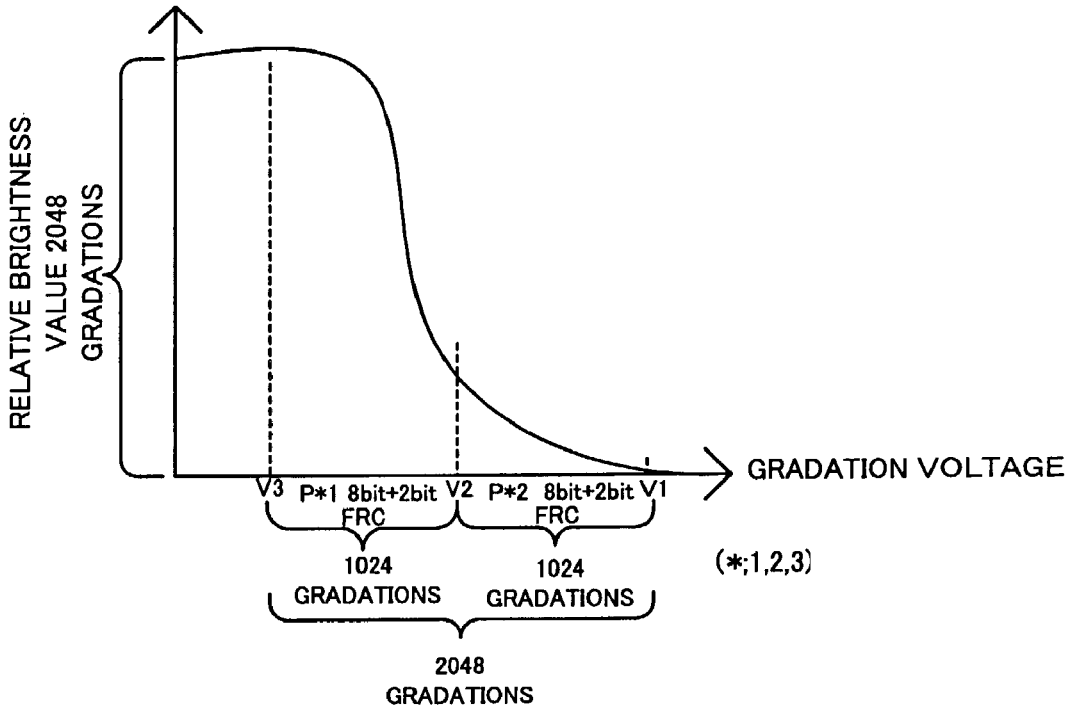

FIG. 7B shows a relationship of a case where the number of gradations displayable by one sub-pixel is that of a case where 10-bit digital data is input, due to applying the FRC processing to digital data which is input to each driver IC. In this case, the number of gradations displayable by each of the pixels p1, p2, and p3 is 2048, which is obtained by doubling 1024. Therefore, in case of a color liquid crystal panel, 2048×3 colors can be displayed by each unit pixel p. In case of a monochrome liquid crystal panel, 6144 (2048×3) gradations can be displayed by each unit pixel p.

As described above, in the liquid crystal panel according to the present embodiment, the pixels p1, p2, and p3 are respectively divided into sub-pixels p11, p21, and p31, and sub-pixels p12, p22, and p32 which are equal-sized and driven by different driver ICs. Therefore, it is possible to perform multi-gradation display which is greater than multi-gradation display acquired by a conventional liquid crystal panel, without using a complicated circuit structure, but using existing driver ICs. According to the present embodiment, the number of displayable gradations is reduced as compared to the first embodiment. However, since the areas of the sub-pixels originating from the common pixel are equal to each other, the structure is simpler than that of the first embodiment.

In the first and second embodiments, the driver ICs are arranged separately on the upper side and lower side of the liquid crystal panel. However, a single driver IC may be arranged on either side of the liquid crystal panel. The following will explain an embodiment where the driver IC is arranged only on the upper side of the liquid crystal panel.

Third Embodiment

Figure 9:
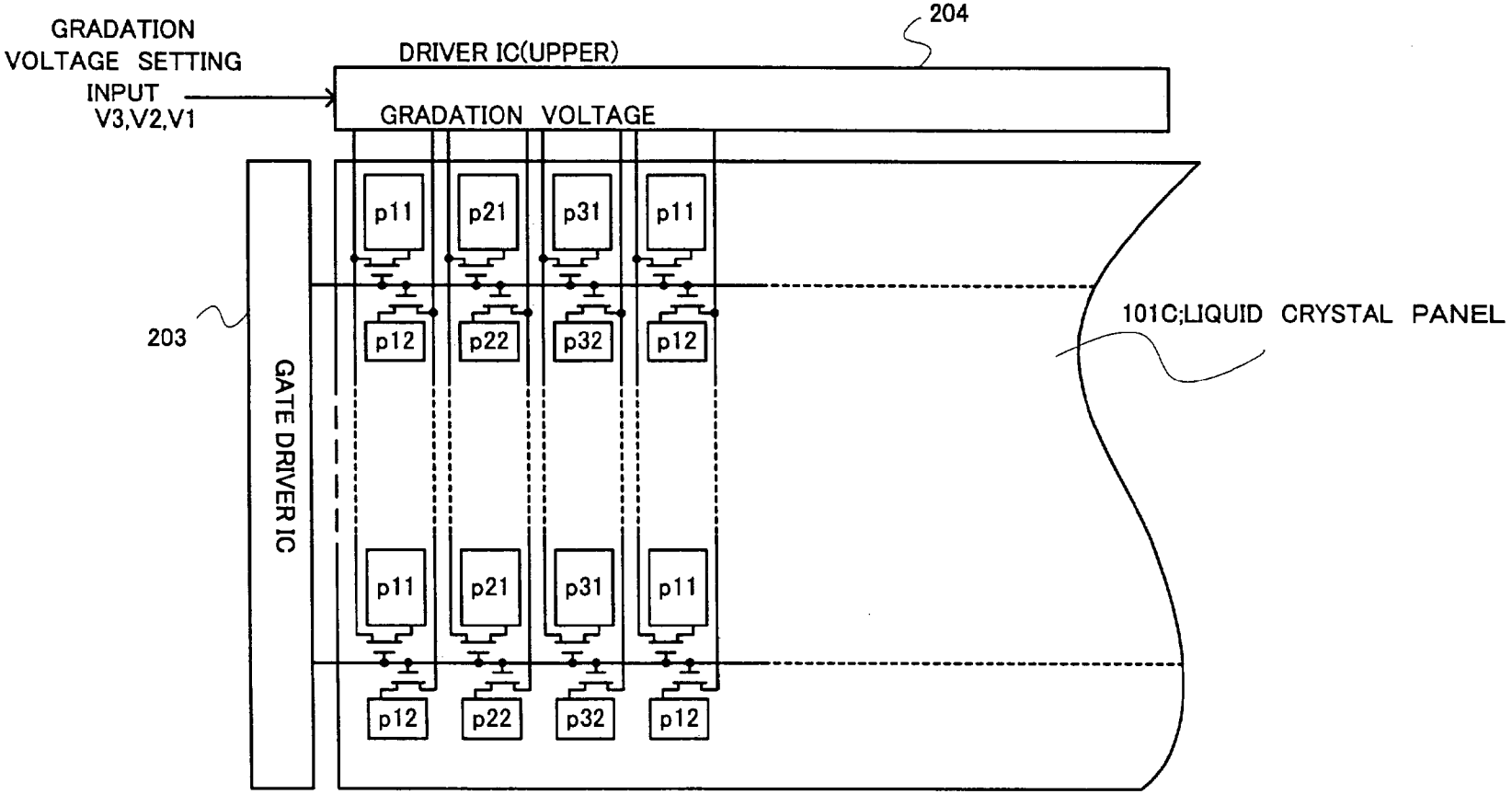
FIG. 9 is a circuit diagram showing a basic structure of a liquid crystal panel according to a third embodiment of the present invention.
Figure 10:
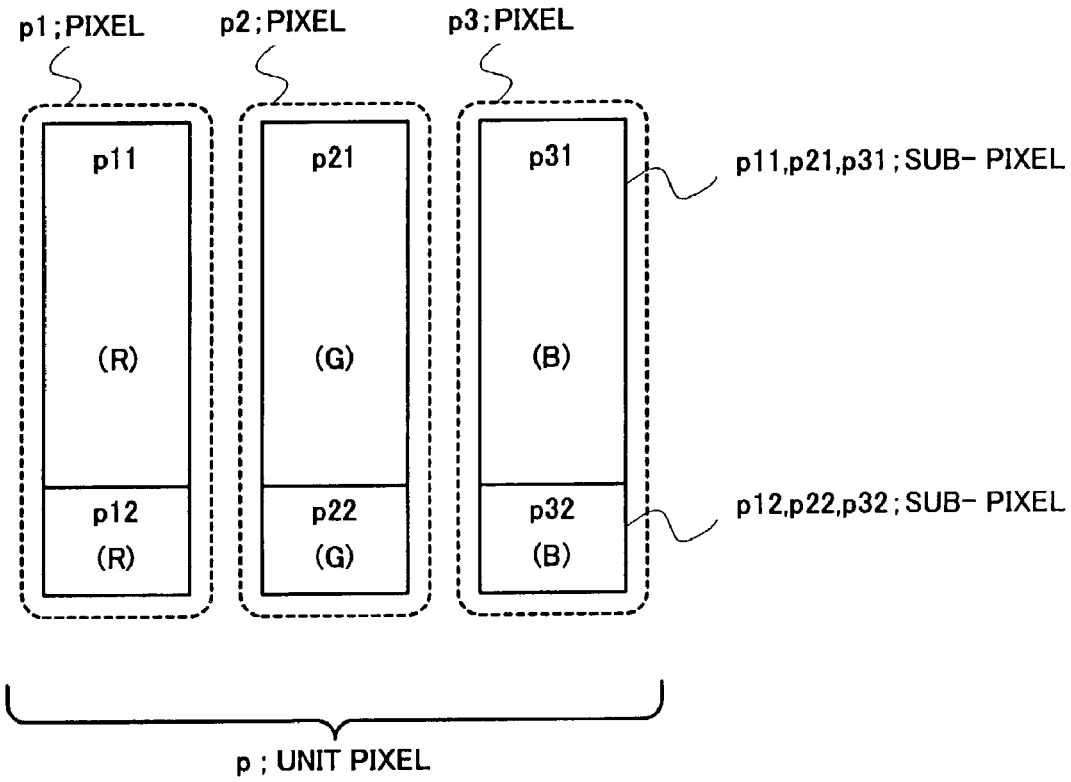
FIG. 10 is a diagram showing a structure of a unit pixel in the liquid crystal panel of the third embodiment.
Figure 11:
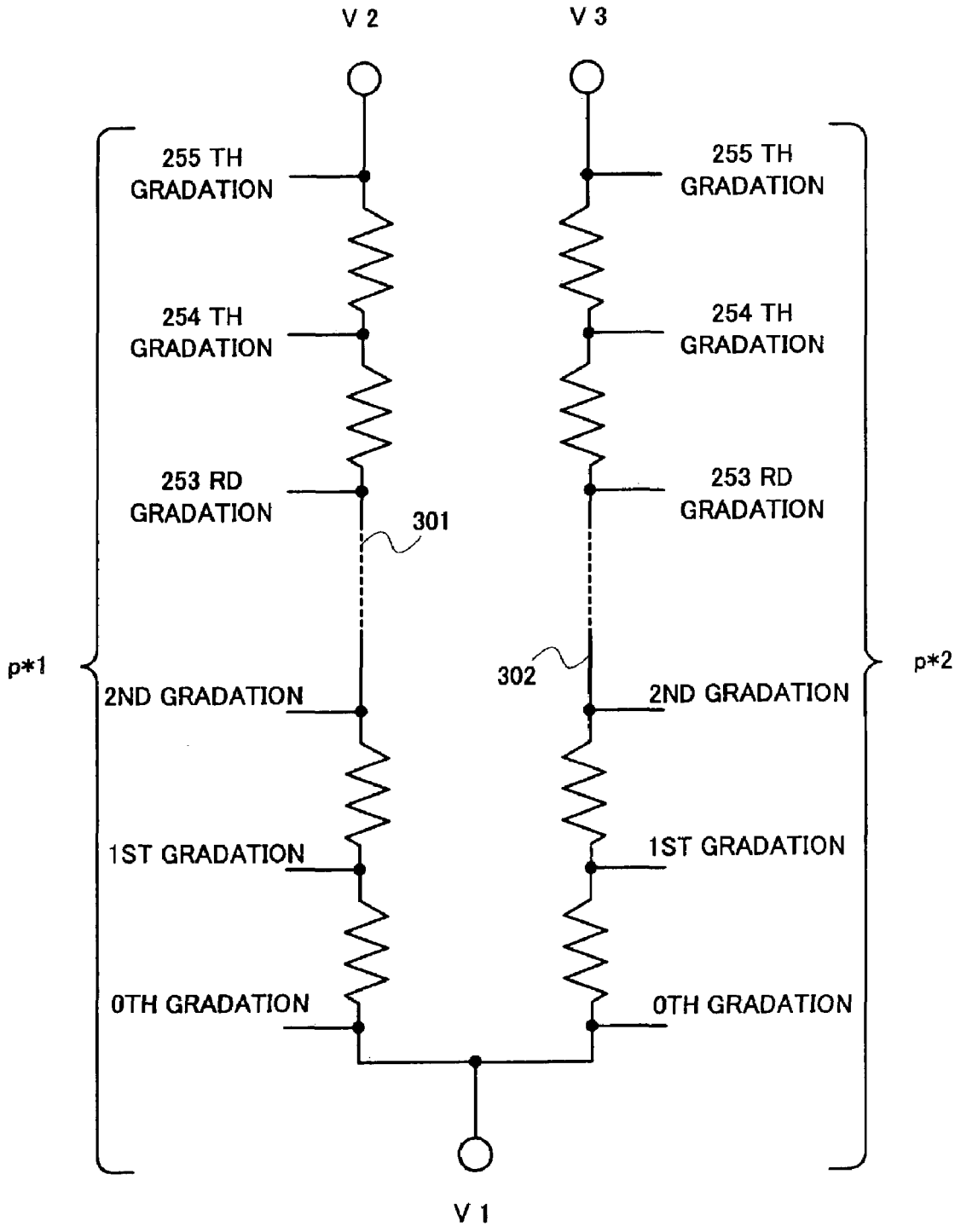
FIG. 11 is a diagram showing a structure of a ladder resistor for generating gradation voltages, in the liquid crystal panel of the third embodiment.
Figure 12:
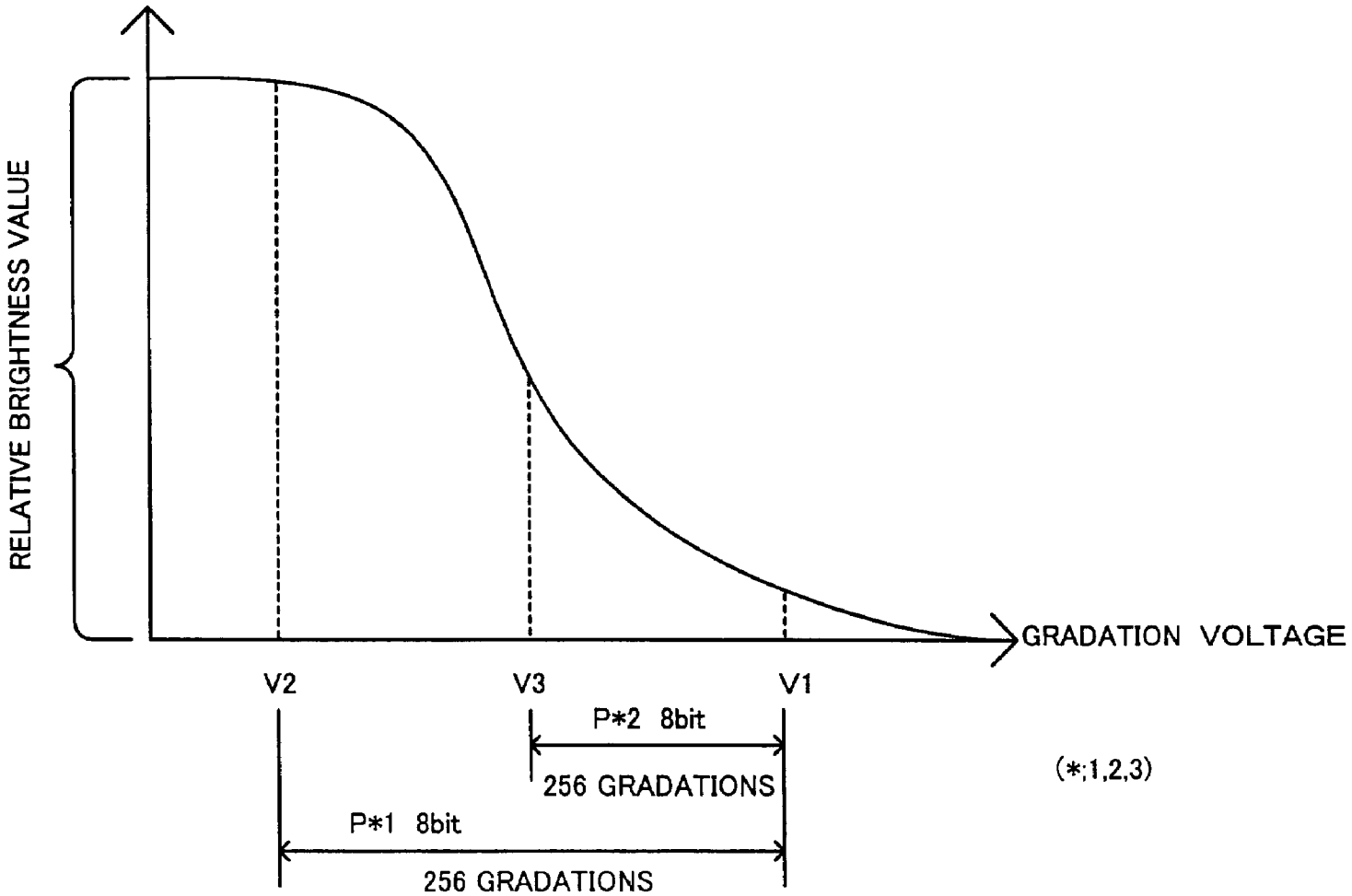
FIG. 12 is a diagram showing a relationship between gradation voltages and relative brightness values according to the liquid crystal panel of the third embodiment.

FIG. 9 is a circuit diagram showing the basic structure of a liquid crystal panel according to the third embodiment of the present invention. FIG. 10 is a diagram showing the structure of a unit pixel included in the liquid crystal panel according to the present embodiment. FIG. 11 is a diagram showing the structure of a ladder resistor for generating gradation voltages according to the liquid crystal panel of the present embodiment. FIG. 12 is a diagram showing a relationship between gradation voltages and relative brightness values according to the liquid crystal panel of the present embodiment.

FIG. 9 shows the schematic structures of a liquid crystal panel 101C, a driver IC 204, and a gate driver IC 203, according to the present embodiment. The arrangement of the sub-pixels in the liquid crystal panel 101C according to the present embodiment is the same as that in the liquid crystal panel 101A according to the first embodiment. The difference between the present embodiment and the first and second embodiments is that the driver IC 204 for driving pixels is arranged on the upper side of the liquid crystal panel 101C, and sub-pixels included in both of the groups p*1 and p*2 are driven by the common driver IC 204, according to the present embodiment. FIG. 10 shows the structure of each sub-pixel included in the liquid crystal panel 101C shown in FIG. 9. However, the structure of each sub-pixel is the same as that of the first embodiment. Therefore, the explanation will be omitted.

FIG. 11 shows the structure of a ladder resistor for generating gradation voltages, which is included in the driver IC 204. The ladder resistor for generating gradation voltages is constituted by a resistor voltage divider 301 for the group of sub-pixels p*1, and a resistor voltage divider 302 for the group of sub-pixels p*2. The resistor voltage divider 301 generates 256 gradation voltages corresponding to 0 to 255 gradations within the range of gradation voltage setting inputs V2 to V1, and supplies the generated gradation voltages to the sub-pixels included in the group p*1. The resistor voltage divider 302 generates 256 gradation voltages corresponding to 0 to 255 gradations within the range of gradation voltage setting inputs V3 to V1, and supplies the generated gradation voltages to the sub-pixels included in the group p*2.

The node of the voltage V1 of the resistor voltage divider 301 and the node of the voltage V1 of the resistor voltage divider 302 are connected to each other inside the driver IC 204. A gradation voltage generated by the resistor voltage divider 301 based on a gradation voltage setting input within the V2–V1 range is supplied to a sub-pixel in the group p*1 through an odd number-th output from the driver IC 204. A gradation voltage generated by the resistor voltage divider 302 based on a gradation voltage setting input within the V3–V1 range is supplied to a sub-pixel in the group p*2 through an even number-th output from the driver IC 204.

The relationship between gradation voltages and relative brightness values is the same as that of the first embodiment. As shown in FIG. 12, the gradation voltage setting input V2 is the maximum value of the voltage to be applied to a liquid crystal cell, among the gradation-brightness value characteristics of the liquid crystal panel 101C, while the gradation voltage setting input V1 is the minimum value. The gradation voltage setting input V3 causes a voltage which generates a relative brightness corresponding to the weight of the bottom 8 bits included in 16-bit digital data.

As described above, in the liquid crystal panel 101C according to the present embodiment, the sub-pixels included in both of the group p*1 and the group p*2 are driven by the common driver IC 204. Therefore, it is possible to connect the node of the gradation voltage setting input V1 for driving the sub-pixels of the group p*1 and the node of the gradation voltage setting input V1 for driving the sub-pixels of the group p*2 inside the driver IC 204. Accordingly, it is possible to prevent occurrence of unevenness in the displayed gradations due to the margin of errors in the gradation voltage setting inputs between two driver ICs, which could happen in the case of the first embodiment where V1 nodes are separate between the upper driver IC 201 and the lower driver IC 202.

Figure 13:
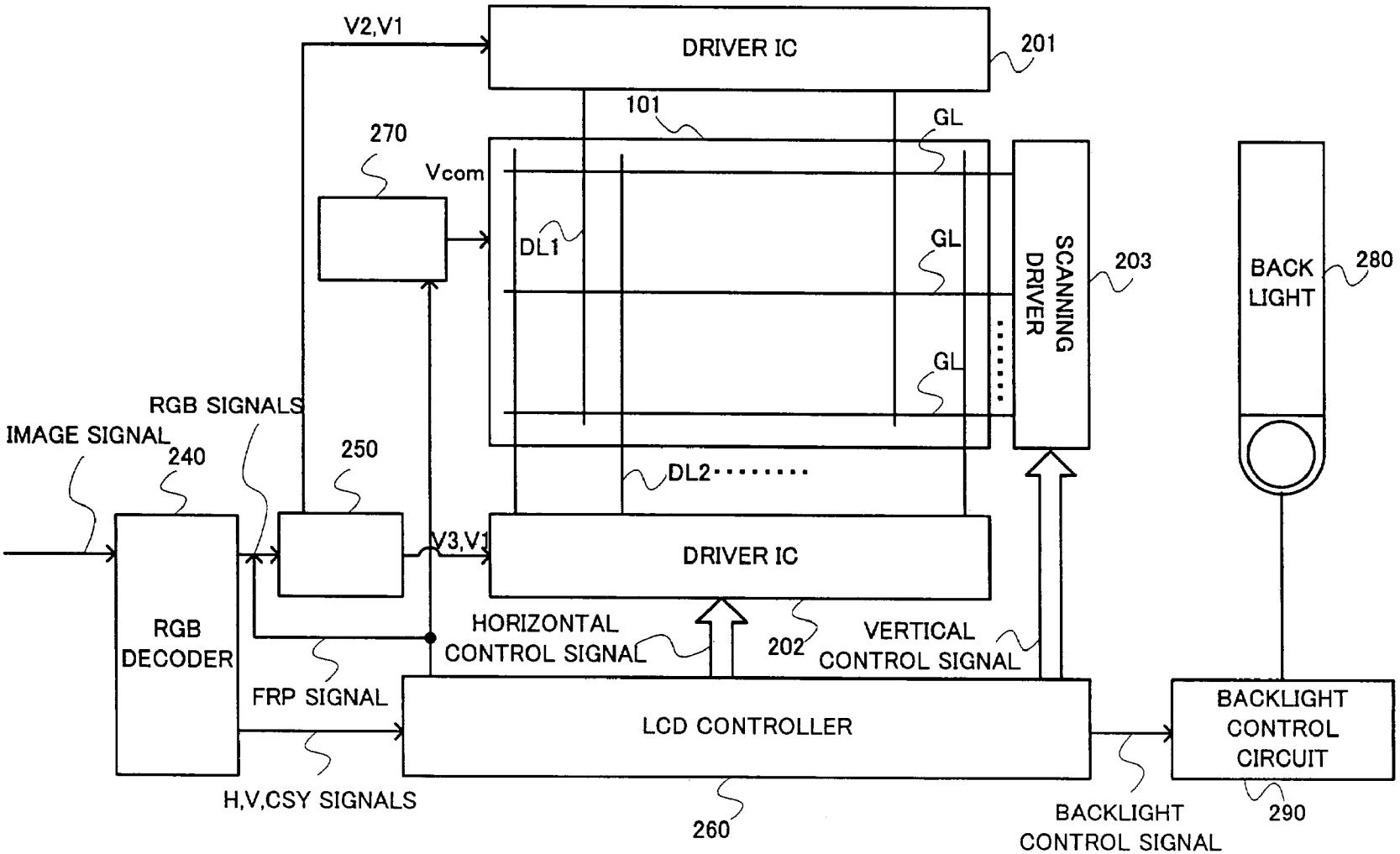
FIG. 13 is a diagram showing a basic structure of the liquid crystal panel according to the first embodiment.

FIG. 13 is a diagram showing the basic structure of the liquid crystal panel according to the first embodiment of the present invention. The liquid crystal panel 101 comprises driver ICs 201 and 202, a scanning driver 203, an RGB decoder 240, a gradation-brightness value characteristic controller 250, an LCD controller 260, a common signal drive amplifier 270, a backlight 280, and a backlight control circuit (inverter circuit) 290.

The liquid crystal panel 101 has an active matrix type TFT structure, where liquid crystal layer is sandwiched between two substrates. Gate lines GL and drain lines DL are arranged in the row direction and in the column direction like a matrix on the surface of the lower substrate. A plurality of unit pixels are built in the matrix structure, and each unit pixel has a pixel electrode. A common electrode is formed on the surface of the upper substrate so as to be opposed to the pixel electrodes.

The drain lines DL are connected to the driver ICs 201 and 202. The driver ICs 201 and 202 store predetermined image data for each line based on a horizontal control signal, and supply corresponding image display signals to the drain lines DL in a sequential manner. The gate lines GL are connected to the scanning driver 203. The scanning driver 203 sequentially applies, based on a vertical control signal, scanning signals to the gate lines GL so that the gate lines GL are in a selected state, and applies a voltage same as that of the image display signals supplied to the drain lines, to the pixel electrodes arranged at the intersections of the gate lines GL and the drain lines DL.

The RGB decoder 240 extracts a vertical clock signal (V), a horizontal clock signal (H), and a synchronization signal (CSY) from an image signal, and supplies the extracted signals to the LCD controller 260. Also, the RGB decoder 240 extracts color signals (R,G, and B signals) of red (R), green (G), and blue (B) from the image signal based on a field/line reverse signal FRP output from the LCD controller 260, converts the R, G, and B signals into digital R, G, and B signals of a predetermined bit width, and supplies the reversed R, G, and B signals to the driver ICs 201 and 202.

In this case, the gradation-brightness value characteristic controller 250 drives the sub-pixels constituting each pixel to have gradation-brightness value characteristics different from each other based on the reversed R, G, and B signals from the RGB decoder 240 and the field/line reverse signal FRP from the LCD controller 260. For example, in a case where the sub-pixels constituting each pixel have different areas from each other, the gradation-brightness value characteristic controller 250 gives the sub-pixel having the larger area a gradation-brightness value characteristic of wider brightness value range through the drain line DL1, and gives the sub-pixel having the smaller area a gradation-brightness value characteristic of a narrower brightness value range through the drain line DL2. Such a voltage control is performed by the gradation-brightness value characteristic controller 250.

The LCD controller 260 generates the aforementioned field/line reverse signal FRP based on the horizontal clock signal (H), the vertical clock signal (V), and the synchronization signal (CSY) supplied from the RGB decoder 240, and outputs the generated signal to the gradation-brightness value characteristic controller 250. The LCD controller 260 also generates a horizontal control signal and a vertical control signal, and supplies the horizontal signal to the driver ICs 201 and 202, and the vertical signal to the scanning driver 203. Thereby, signal voltages are applied to the pixel electrodes at predetermined timings, and display data is written on the liquid crystal panel 101.

The common signal driver amp 270 generates and outputs a common signal Vcom for driving a common potential to be applied to the common electrode of the liquid crystal panel 101, based on the field/line reverse signal FRP output from the LCD controller 260. The backlight 280 is set at the back of the liquid crystal panel 101, and its lighting operation is controlled by the backlight control circuit 290. The backlight control circuit 290 controls the backlight 280 based on a backlight control signal output from the LCD controller 260.

Figure 14:
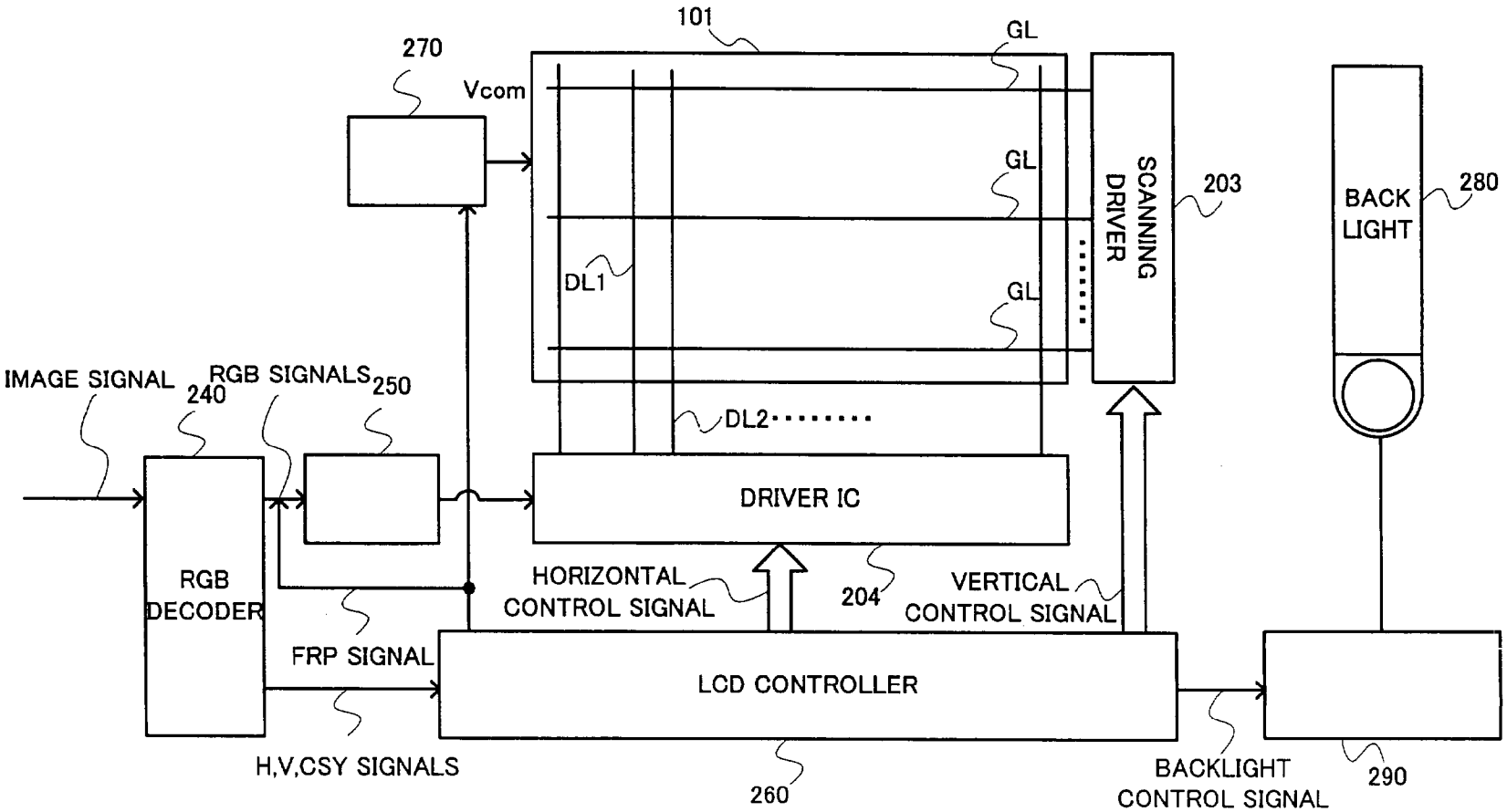
FIG. 14 is a diagram showing a basic structure of the liquid crystal panel according to the third embodiment.

FIG. 14 is a diagram showing the basic structure of the liquid crystal panel according to the third embodiment of the present invention. The difference between FIG. 14 and FIG. 13 is that in FIG. 14, there is only one driver IC 204. In FIG. 13, the driver IC 201 and the driver IC 202 supply data to the drain lines DL alternately like comb-teeth. According to the third embodiment, the driver IC 204 supplies voltages to all the sub-pixels.

Figure 15:
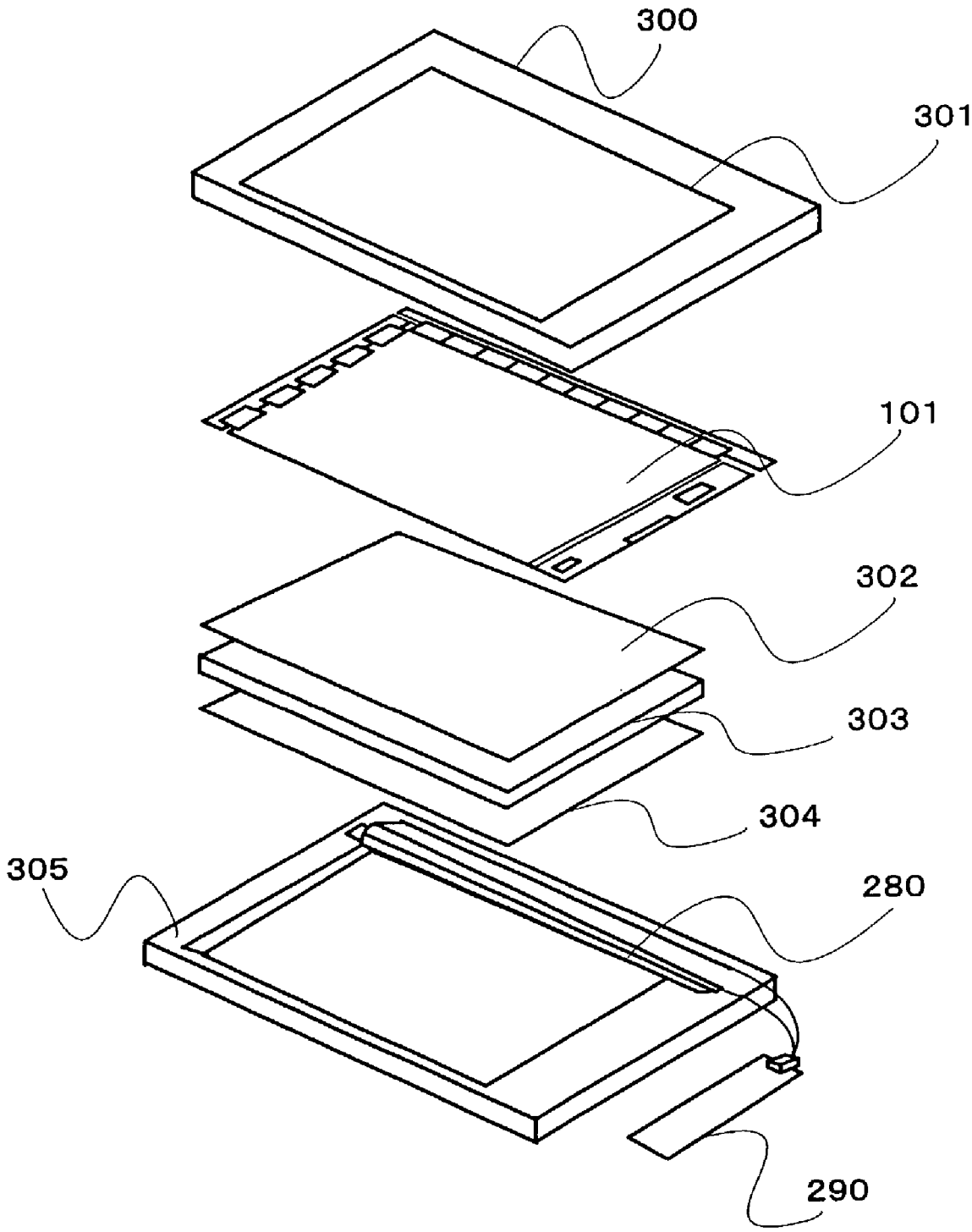
FIG. 15 is a diagram showing a basic structure of a liquid crystal display device according to the present invention.
Figure 16:
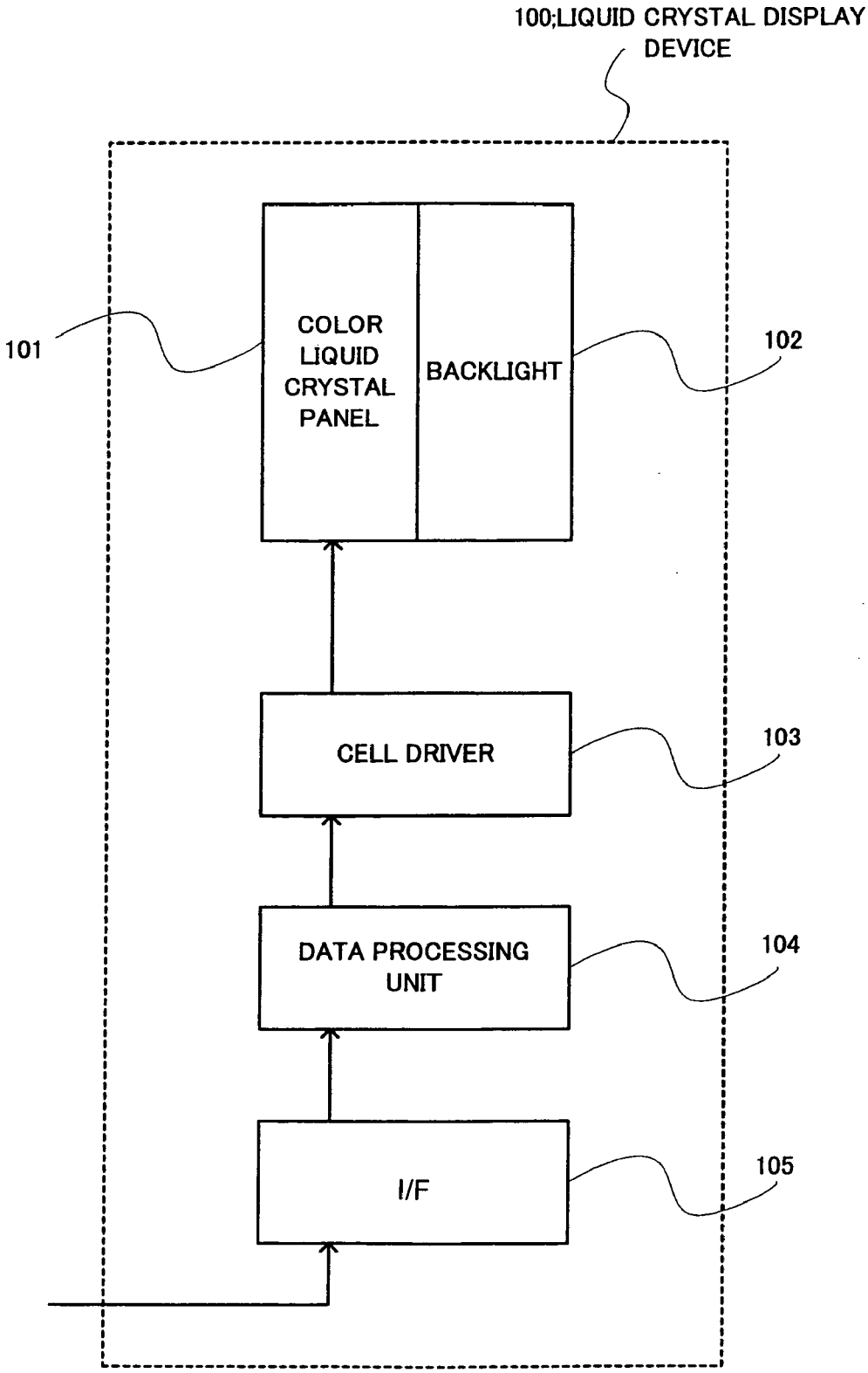
FIG. 16 (PRIOR ART)
FIG. 16 is a block diagram showing an example of a structure of a conventional liquid crystal panel to which the present invention is to be applied.
Figure 17A:
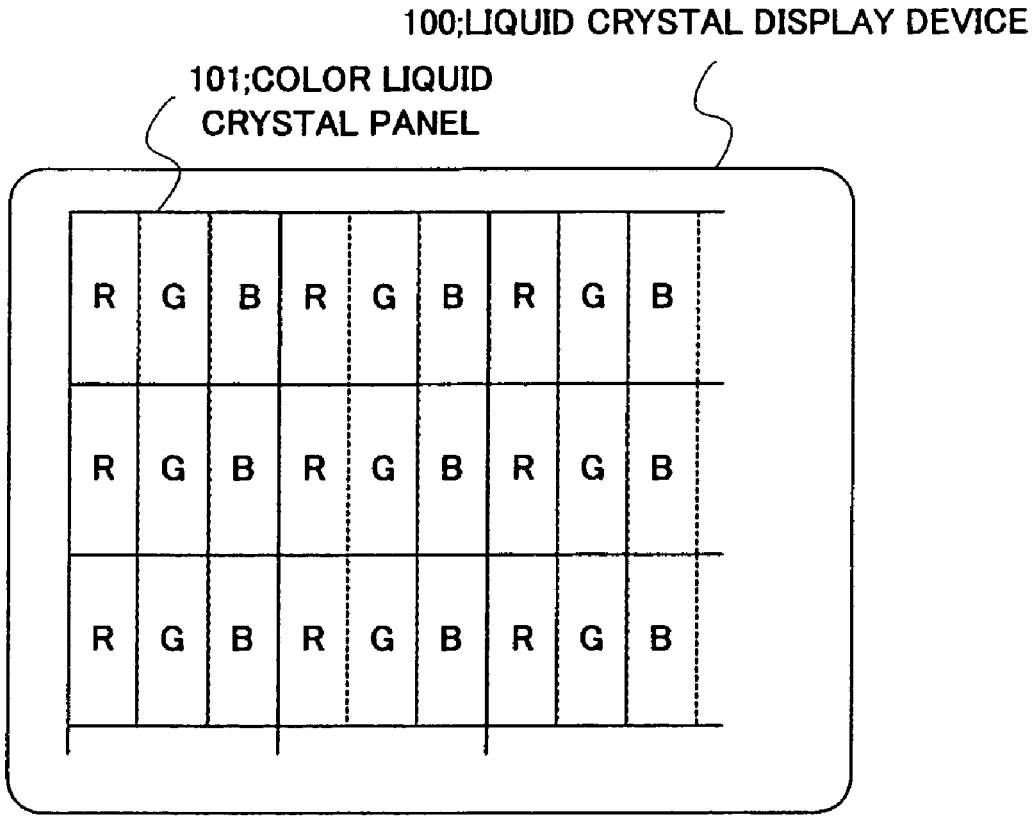
FIG. 17A (PRIOR ART)
FIGS. 17A and 17B are diagrams showing an example of a structure of a display screen in the conventional liquid crystal panel.
Figure 17B:
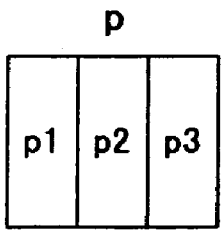
FIG. 17B (PRIOR ART)
Figure 18:
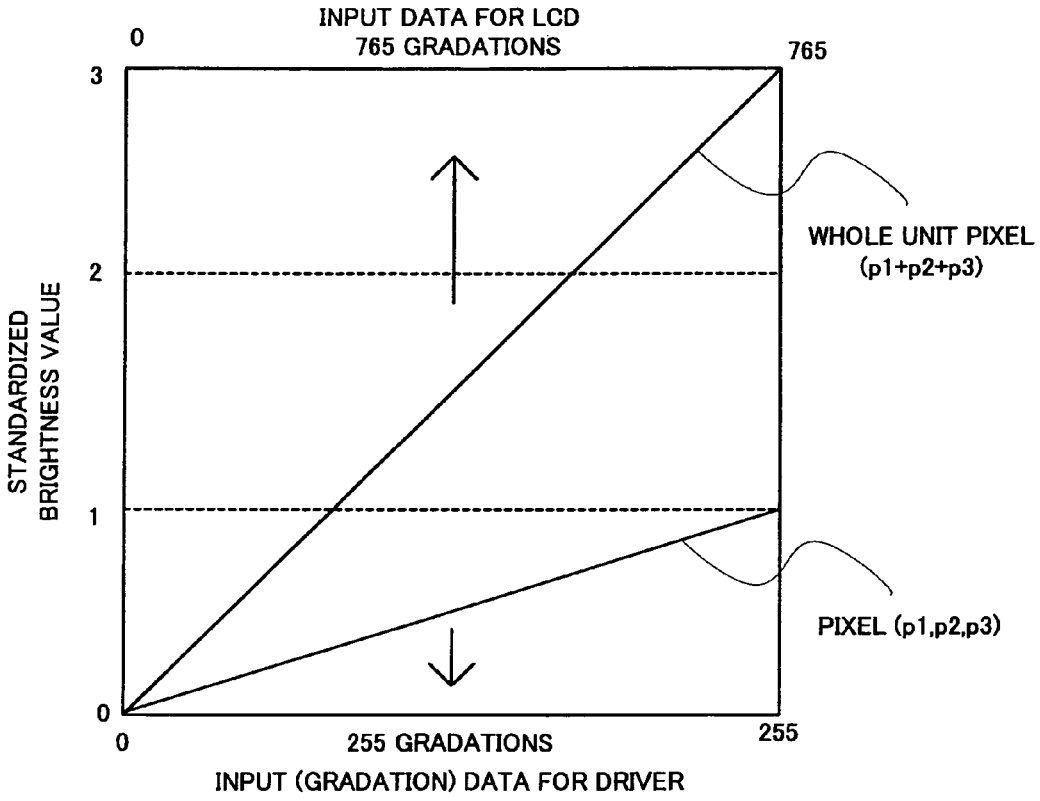
FIG. 18 (PRIOR ART)
FIG. 18 is a diagram showing a relationship between brightness values of a unit pixel and brightness values of each sub-pixel, according to the conventional liquid crystal panel.

FIG. 15 is a diagram showing the basis structure of the liquid crystal display device of the present invention. The liquid crystal display device according to the embodiments of the present invention comprises a shield case 300, a liquid crystal panel 101, a dispersion plate 302, a light guide plate 303, a reflection plate 304, a lower case 305, the backlight 280, and the control circuit 290. However, constitution of the liquid crystal display device is not limited to the above.

The shield case 300 is a metal plate for shielding the liquid crystal panel 101 and the backlight 280 from external shocks. A display window is provided to the shield case 300. The liquid crystal panel 101 is exposed from the opening of this display window. The exposed area of the liquid crystal panel 101 is the display area. The driver ICs and the common driver IC which are divided into plural portions are arranged on the non-display area of the liquid crystal panel 101.

The dispersion plate 302 is used for dispersing light from the backlight 280 to keep the brightness of the surface of the liquid crystal panel 101 uniform. These optical parts may be variously changed in accordance with the type and arrangement of the light source to be used. According to the embodiments of the present invention, the light guide plate 303 is used, and the dispersion plate 302 is arranged at the light emitting surface side of the light guide plate 303.

The light guide plate 303 is used for guiding light from the light source and dispersing the light. The light guide plate 303 is a transparent plate having a dispersion pattern on the surface thereof, although not necessarily limited to this. The shape of the cross section of the dispersion pattern varies in accordance with the type of the light source to be used.

The reflection plate 304 is used for reflecting light from the light source, in order to effectively use the light source as a backlight. According to the embodiments of the present invention, the reflection plate 304 is used for reflecting light from the surfaces of the light guide plate 303 other than the front surface thereof, although not necessarily limited to this.

The lower case 305 is a metal plate for shielding the liquid crystal panel 101 and the backlight 280, etc. from external shocks, as well as the shield case 300. The backlight 280 and the control circuit 290 are mounted on this lower case 305, although not necessarily limited to this.

The backlight 280 is a light source for irradiating light onto the liquid crystal panel 101. According to the embodiments of the present invention, a driving method for an active-matrix type is employed. Various types of lights can be used as the backlight 280. A sidelight type and an under light type can be both employed in the present invention.

The control circuit 290 is an electric circuit for generating a high-frequency voltage for lighting the backlight 280. The control circuit 290 is shielded by the lower case 305 against being touched from outside, because the control circuit 290 reaches a higher voltage compared to other electric circuits.

As described above, according to the embodiments of the present invention, the liquid crystal display device constituted by the shield case 300, the liquid crystal panel 101, the dispersion plate 302, the light guide plate 303, the reflection plate 304, the lower case 305, a backlight 280, and the control circuit 290 is used. However, the liquid crystal display device according to the embodiments of the present invention is not limited to this constitution, but can be variously changed. For example, in case of a cellular phone, these components may be arranged inside the phone body without using the shield case 300. Further, the dispersion plate 304 and the light guide plate 303 may not be used if an enhanced backlight is used as the backlight 280.

The embodiments of the present invention have been explained with reference to the drawings. The detailed structures of the liquid crystal display device and liquid crystal panel, etc. are not limited to those in the explained embodiments, but changes in the design of these structures are also included in the present invention as long as such changes are not beyond the meaning of the present invention. For example, according to the first and second embodiments, the first driver IC and the second driver IC may not be positioned on the upper side and lower side of the liquid crystal panel, but may be positioned on the right side and the left side. Further, according to the third embodiment, the driver IC may not be on the upper side of the liquid crystal panel, but may be on the lower side thereof.

The FRC processing may not be limited only to the second embodiment, but may be employed in the first and third embodiments. In the third embodiment, the explanation has been that the area ratio between the sub-pixels constituting each pixel is other than 1, likewise the first embodiment. However, the area ratio between the sub-pixels may be 1, likewise the second embodiment. Further, the present invention can be applied not only to a color liquid crystal panel, but also to a monochrome liquid crystal panel where a unit pixel constituting the liquid crystal panel is made up of a single pixel.

As has been explained, according to the liquid crystal display device of the present invention, it is possible to perform multi-gradation display greater than that by a conventional liquid crystal display device, by constituting each pixel with sub-pixels and by driving the sub pixels using different driver ICs, without using a complicated circuit structure but using an existing driver ICs. Further, according to the liquid crystal display device of the present invention, it is possible to perform multi-gradation display greater than that achieved by a conventional liquid crystal display device, by constituting each pixel with sub-pixels and driving the sub-pixels using a common driver IC, although a novel driver IC must be prepared.

Various embodiments and changes may be made thereunto without departing from the broad spirit and scope of the invention. The above-described embodiments are intended to illustrate the present invention, not to limit the scope of the present invention. The scope of the present invention is shown by the attached claims rather than the embodiments. Various modifications made within the meaning of an equivalent of the claims of the invention and within the claims are to be regarded to be in the scope of the present invention.

This application is based on the Japanese Patent Application No. 2002-112713 filed on Apr. 15, 2002, and we claim the priority of the invention. The disclosure of the above Japanese Patent Application is incorporated herein by reference in its entirety.

What is claimed is:

1. A method of driving a liquid crystal display device where a plurality of pixels constituting each unit pixel and each of said plurality of pixels divided into a first and a second sub-pixels, said method comprising:

a step of supplying a first driver with a voltage changeable within a range of a predetermined voltage V2 to a predetermined voltage V1, as an input value of a gradation voltage for driving the first sub-pixel;

a step of supplying a second driver with a voltage changeable within a range of a predetermined voltage V3 and said predetermined voltage V1, as an input value of a gradation voltage for driving said second sub-pixel, and a relationship among said voltages V3, V2, and V1 represented by V2>V3>V1.

2. The method of driving said liquid crystal display device according to claim 1, wherein said predetermined voltage V2 is a maximum value of a drive voltage to be applied to said first sub-pixel, and said predetermined voltage V1 is a minimum value of a drive voltage to be applied to said first sub-pixel.

3. The method of driving said liquid crystal display device according to claim 1, wherein said predetermined voltage V3 is a maximum value of a drive voltage to be applied to said second sub-pixel.

4. The method of driving the liquid crystal display device according to claim 1, wherein said plurality of pixels are for displaying a color image.

* * * * *